US007717075B2

(12) United States Patent
Endoh et al.

(10) Patent No.: US 7,717,075 B2
(45) Date of Patent: May 18, 2010

(54) CAM MECHANISM HAVING FORCED-VALVE-OPENING/CLOSING CAMS AND CAM-PROFILE SETTING METHOD

(75) Inventors: Tsuneo Endoh, Wako (JP); Makoto Uda, Wako (JP); Hiroshi Hanabusa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 386 days.

(21) Appl. No.: 11/978,635

(22) Filed: Oct. 30, 2007

(65) Prior Publication Data

US 2008/0110425 A1 May 15, 2008

(30) Foreign Application Priority Data

Nov. 14, 2006 (JP) ..... P2006-308110
Dec. 15, 2006 (JP) ..... P2006-339071

(51) Int. Cl.
*F01L 1/30* (2006.01)

(52) U.S. Cl. ..... 123/90.24; 123/90.16; 29/888.1

(58) Field of Classification Search ..... 123/90.15, 123/90.16, 90.24; 29/888.1
See application file for complete search history.

(56) References Cited

U.S. PATENT DOCUMENTS

2003/0106515 A1* 6/2003 Kondo ..... 123/179.4

FOREIGN PATENT DOCUMENTS

JP 60-108513 A 6/1985
JP 6-221119 A 8/1994

* cited by examiner

*Primary Examiner*—Zelalem Eshete
(74) *Attorney, Agent, or Firm*—Birch, Stewart, Kolasch & Birch, LLP

(57) ABSTRACT

No-load valve lift correction curves of opening and closing cams are set by offsetting no-load curve sections of basic valve lift curves of the cams in such directions as to increase a clearance between the curves, and they are connected with remaining sections of the curves to provide normal valve lift curves of the cams. Cam profiles of the cams are set on the basis of such normal valve lift curves. The cam profiles are set so that an ultimate speed difference between jumping and landing speeds of a follower on an ultimate valve speed curve determined from ultimate valve lift curves, having first and second shift sections where the follower shifts from the opening cam to the closing cam and from the closing cam to the opening cam, is smaller than a basic speed difference between jumping and landing speeds on a basic valve speed curve.

9 Claims, 13 Drawing Sheets

(a)
INVENTIVE EXAMPLE
(b)
COMPARATIVE EXAMPLE
(c)
INVENTIVE EXAMPLE
(d)
COMPARATIVE EXAMPLE
22a
111 (45)
111A
111L
101T
101A
101 (44)
θi1
103
(42)
306L
301T
θi11
302
306
301
111T
111B
116
101B
θi2
101L
308
306T
301L
θi12
α1
θ1
α2
α4
θ3
α5

CAM MECHANISM HAVING FORCED-VALVE-OPENING/CLOSING CAMS AND CAM-PROFILE SETTING METHOD

FIELD OF THE INVENTION

The present invention relates to improvements in a cam mechanism having forced-valve-opening/closing cams and cam-profile setting method for the valve-opening/closing cams.

BACKGROUND OF THE INVENTION

Among the internal combustion engines known today are ones provided with a valve operating device of a forced-valve-opening/closing type that forcibly drives air intake and exhaust valves by means of cams directly or via rocker arms.

Such a valve operating device of the forced-valve-opening/closing type requires both cams for opening the valves (i.e., valve-opening cams) and cams for closing the valves (i.e., valve-closing cams). In the case where the valves are driven by means of these valve-opening and valve-closing cams directly or via rocker arms, some clearances are provided between the valve-opening and valve-closing cams and the valves in consideration of respective machining or manufacturing accuracy and assembling accuracy, thermal expansion/shrinkage, etc. of the valves, rocker arms, cams and other valve operating component parts.

The above-mentioned clearances can be represented by a valve lift amount difference between a valve lift curve that is indicative of relationship between a rotation angle of the valve-opening cam and a valve lift amount, and a valve lift curve that is indicative of relationship between a rotation angle of the valve-closing cam and a valve lift amount, as will be explained below.

FIG. 13 is a graph showing operating characteristics of the conventionally-known valve-opening and valve-dosing cams, where the vertical axis represents the valve lift amounts, valve speeds determined by one of the valve lift amounts and valve acceleration determined by the valve speed while the horizontal axis represents the cam rotation angles. The valve lift curve 301 of the valve-opening cam, which is a curve having a middle curve section of a high mountain shape, has an inflexion point 302 at a cam rotation angle θ1, inflexion point 303 at a cam rotation angle θ3 and maximum lift point 304 at a cam rotation angle θ2.

The valve lift curve 306 of the valve-closing cam is a curve plotted by displacing the above-mentioned valve lift curve 301 upwardly by a clearance CC, and it has two inflexion points 307 and 308 and maximum lift point 309.

The valve speed curve 311, which is obtained by differentiating one of the above-mentioned valve lift curves 301 and 306, has a maximum speed point 312 corresponding to the inflexion points 302 and 307 of the valve lift curves 301 and 306, a zero speed point 313 corresponding to the maximum lift points 304 and 309 of the curves 301 and 306, and a minimum speed point 314 corresponding to the inflexion points 303 and 308 of the curves 301 and 306.

Although separate valve speed curves are obtained separately in correspondence with the valve lift curves 301 and 306, only one of the valve speed curves 311 is shown and described here because the valve speed curves corresponding to the valve lift curves 301 and 306 are of the same shape.

The above-mentioned maximum speed point 312 is a "jumping point" where the follower (provided directly on the air intake valve or exhaust valve or on the rocker arm) moves or jumps away from (i.e., disengages from) the operating surface (i.e., cam surface) of the valve-opening cam. Further, reference numeral 316 in FIG. 13 represents a landing point where the follower lands on the cam surface of the valve-closing cam. Furthermore, VU represents a valve speed at the maximum speed point 312, and ΔVU represents a difference between the valve speed at the maximum speed point (jumping point) 312 (i.e., jumping speed) and a valve speed at the landing point 316 (i.e., landing speed). The landing speed is a speed at which the follower lands on the cam surface of the valve-closing cam; it should be noted here that the landing speed is distinguished from a colliding speed at which the follower collides against the cam surface of the valve-closing cam (the colliding speed corresponds to the above-mentioned speed difference ΔVU).

Similarly, the above-mentioned minimum speed point 314 is a "jumping point" where the follower moves or jumps away from the cam surface of the valve-closing cam. Further, reference numeral 318 in FIG. 13 represents a landing point where the follower lands on the cam surface of the valve-opening cam. Furthermore, VL represents a valve speed at the minimum speed point 314, and ΔVL represents a difference between the jumping speed at the minimum speed point (jumping point) 314 and a landing speed at the landing point 318. The landing speed is a speed at which the follower lands on the cam surface of the valve-opening cam; it should be noted here that the landing speed is distinguished from a colliding speed at which the follower collides against the cam surface of the valve-opening cam (the colliding speed corresponds to the above-mentioned speed difference ΔVL).

The valve acceleration curve 321, which is obtained by differentiating the above-mentioned valve speed curve 311, has a zero acceleration point 322 corresponding to the maximum speed point 312 of the valve speed curve 311, a minimum acceleration point 323 corresponding to the zero speed point 313 of the valve speed curve 311, and a zero acceleration point 324 corresponding to the minimum speed point 314 of the valve speed curve 311.

Although separate valve acceleration curves are obtained separately from the valve speed curves obtained in correspondence with the valve lift curves 301 and 306 as noted above, only one of the valve acceleration curves 321 is explained because the two valve acceleration curves are of the same shape.

As stated above, the clearance CC is provided between the valve lift curves 301 and 306. Thus, in the case where the valves are driven by the cams directly, the intake valve and exhaust valve first temporarily move away from the valve-opening cam and valve-closing cam and then collide with the cams, because of the provision of the clearance CC between the cams. In the case where the valves are driven by the cams via the rocker arms, on the other hand, the rocker arms first temporarily move away from the valve-opening cam and valve-dosing cam and then collide with the cams, because of the provision of the clearance CC between the cams. Thus, in both of the cases, unwanted sound noise would be produced by the provision of the clearances between the cams.

Particularly, the inflexion point 302 of the valve lift curve 301 is where the operated member (i.e., the air intake valve, exhaust value or rocker arm), slidably contacting the valve-opening cam, moves away from the operating surface of the valve-opening cam, and the inflexion point 308 of the valve lift curve 306 is where the operated member (i.e., the air intake valve, exhaust value or rocker arm), slidably contacting the valve-closing cam, moves away from the operating surface of the valve-closing cam; thus, the valve speeds take maximum absolute values at these inflexion points. Consequently, at these inflexion points, speeds at which the operated members collide with the operating surfaces of the valve-opening and valve-closing cams become great, which would result in increased sound noise.

In order to prevent such unwanted sound noise, there have been proposed, for example in Japanese Patent Application Laid-Open Publication No. SHO-60-108513 (hereinafter referred to as "Patent Literature 1") or No. HEI-6-221119 (hereinafter referred to as "Patent Literature 2"), an improved valve operating device and cam-profile setting method for an internal combustion engine of the forced-valve-opening/closing type, which are characterized in that the clearance between the valve lift curve of the valve-opening cam and the valve lift curve of the valve-closing cam is partly narrowed.

FIG. 14 is a graph showing relationship between the valve lift amounts and the cam rotation angle in the valve operating device for an internal combustion engine disclosed in Patent Literature 1. In the figure, reference character A represents a cam curve of the valve-opening cam, B represents a cam curve of the valve-dosing cam defining a predetermined clearance with respect to the cam curve A, and D represents a cam curve of the valve-closing cam obtained by modifying the cam curve B so as to define a modified clearance with respect to the cam curve A. Namely, in the cam curve D, a curvature in a region "K" between a maximum lift point PE of the cam curve B and a jump start point PD, at which a slipper of a rocker arm driven by the valve-closing cam jumps away from the cam surface of the valve-closing cam toward the cam surface of the valve-opening cam, is set such that the clearance between the cam curves A and D is greater than the clearance between the cam curves A and B.

More specifically, in the cam curve D, the jump start point PD is located more rearward, in a rotational direction of the cam, than an inflexion point PB of the cam curve B, namely, closer to the maximum lift point PE of the cam curve B, and a point at which the slipper of the rocker arm jumps from the jump start point PD toward the cam curve A is not only located closer to the maximum lift point PE than an inflexion point PA2 of the cam curve A but also set in a first region "L", as counted from the inflexion point PB, among four equally-divided regions of a range from the inflexion point PB to the maximum lift point PE of the cam curve B. Further, PA1 in FIG. 14 represents a point where the slipper shifts to the cam curve A after jumping away from the cam curve B. Thus, a section where the slipper of the rocker arm shifts from the cam surface of the valve-closing cam (cam curve D) to the cam surface of the valve-opening cam (cam curve A) has a steep incline, so that impact with which the slipper having jumped at the jump start point PD collides against the cam surface of the valve-opening cam (cam curve A) will be reduced considerably.

FIG. 15 is a graph showing relationship between the valve lift amounts and valve train's inertial force and the cam rotation angle in the valve operating device for an internal combustion engine disclosed in Patent Literature 2. In FIG. 15, the vertical axis represents the valve lift amounts and valve train's inertial force, while the horizontal force represents the cam rotation angles.

Further, in FIG. 15, E represents a valve lift curve of the valve-opening cam, F represents a valve lift curve of the valve-closing cam defining a predetermined clearance with respect to the valve lift curve E, G represents a valve lift curve of the valve-closing cam obtained by modifying part of the valve lift curve F, H represents a curve of the valve train's inertial force, C represents a difference between base circle diameters of the valve-opening cam and valve-closing cam.

Between the valve lift curve E and valve lift curve G, there are formed a clearance C0 (e.g., C0=0.25 mm for the air intake valve or C0=0.35 mm for the exhaust valve) in the valve-opening state, clearance C1 (e.g., C1 is about 0.05 mm) at a cam rotation angle J where the direction of the valve train's inertial force changes, and clearance C2 (=C1) at the time of a maximum valve lift.

With the technique shown in FIG. 14 (i.e., disclosed in Patent Literature 1), the clearance between the cam curves D and A in the above-mentioned region "L", machining or manufacturing accuracy and assembling accuracy decreases as the cam rotation angle increases. If the clearance is small like this, the machining or manufacturing accuracy and assembling accuracy of the component parts of the valve train, such as the valve-opening and valve-closing cams, rocker arms and air intake and exhaust valves, has to be enhanced, which would unavoidably invite cost increase.

With the technique shown in FIG. 15 (i.e., disclosed in Patent Literature 2), the clearance is minimized as close to zero as possible over the range from the maximum lift point to the point of the cam rotation angle J where the direction of the valve train's inertial force changes, and thus, the component parts of the valve train, such as the valve-opening and valve-closing cams, rocker arms, air intake and exhaust valves, must be manufactured and assembled with high accuracy as in the case of the technique disclosed in Patent Literature 1, so that high-accuracy clearance management would require increased necessary cost. Further, if the clearance is small, lubricating oil between the valve-opening and valve-closing cams and the rocker arms would have increased viscosity resistance and agitation resistance, which tends to lower the output and fuel efficiency of the internal combustion engine.

SUMMARY OF THE INVENTION

In view of the foregoing prior art problems, it is an object of the present invention to achieve cost reduction and performance enhancement of an internal combustion engine by setting relatively great clearances between valve-opening and valve-closing cams and air intake and exhaust valves in a predetermined range of cam rotation angles.

It is another object of the present invention to minimize unwanted sound noise in a valve operating device of the forced-valve-opening/closing type by lessening collision between air intake and exhaust valves, or followers provided on rocker arms, and valve-opening and valve-closing cams.

According to a first aspect of the present invention, there is provided a cam mechanism having improved valve-opening and valve-closing cams for forcibly driving an air intake valve and exhaust valve. Basic valve lift curve of the valve-opening cam, indicative of relationship between cam rotation angles and valve lift amounts of the valve-opening cam is plotted in a graph where the vertical axis represents valve lift amounts of the air intake valve and exhaust valve and the horizontal axis represents cam rotation angles, and a basic valve lift curve of the valve-closing cam, indicative of relationship between cam rotation angles and valve lift amounts of the valve-closing cam is plotted in the graph by offsetting the basic valve lift curve of the valve-opening cam in a valve-lift-amount increasing direction. No-load valve lift correction curves of the valve-opening and valve-closing cams are set by offsetting a no-load curve section of the basic valve lift curve of the valve-opening cam, along which a corresponding one of the followers for actuating an air intake valve and exhaust valve does not slide, away from the basic valve lift curve of the valve-closing cam and by offsetting a no-load curve section of the basic valve lift curve of the valve-closing cam, along which the follower does not slide, away from the basic valve lift curve of the valve-opening cam, or by modifying the offset no-load curve sections into desired shapes. Respective normal valve lift curves of the valve-opening and valve-closing cams are formed by connecting the corresponding no-load valve lift correction curves with remaining sections of the corresponding basic valve lift curves; thus, a greater clearance can be provided between the normal valve lift curves of the valve-opening and valve-closing cams. The cam profiles of the valve-opening and valve-closing cams are set on the basis of such normal valve lift curves.

With the increased clearance between given sections of the normal valve lift curves of the valve-opening and valve-closing cams, the present invention can eliminate the need for high-accuracy management of the clearance between these sections of the normal valve lift curves of the valve-opening and valve-closing cams, and thereby eliminate the need for enhancing the manufacturing accuracy and assembling accuracy of various component parts of the valve operating device; as a result, the present invention can achieve significant cost reduction of the internal combustion engine. Further, with the increased clearance, the present invention can reduce viscosity resistance and agitation resistance of lubricating oil between the valve-opening and valve-closing cams and the corresponding follower and thereby enhance the performance, such as the output and fuel efficiency, of the internal combustion engine.

Preferably, the basic valve lift curve of the valve-opening cam and the basic valve lift curve of the valve-closing cam each have a middle curve section of a high mountain shape. Two cam rotation angle ranges including mountain base portions of each of the basic valve lift curves of the valve-opening and valve-closing cams are set as first and second ramp sections, and one of two cam rotation angle ranges, including mountain hillside portions of each of the basic valve lift curves, where the follower of the air intake valve or exhaust valve shifts from the valve-opening cam to the valve-closing cam, is set as a first shift section while the other of the two cam rotation angle ranges, where the follower shifts from the valve-closing cam to the valve-opening cam, is set as a second shift section. Another cam rotation angle range including a mountain top portion of each of the basic valve lift curves being is as a great lift section. The normal valve lift curve of the valve-opening cam is formed by connecting together: the no-load valve lift correction curve of the valve-opening cam, formed by offsetting the great lift section of the basic valve lift curve of the valve-opening cam in a valve-lift-amount decreasing direction; the first and second shift sections of the basic valve lift curve of the valve-opening cam; and the first and second ramp sections of the basic valve lift curve of the valve-opening cam; the cam profile of the valve-opening cam is set on the basis of the normal valve lift curve. Similarly, the normal valve lift curve of the valve-closing cam is formed by connecting together: the no-load valve lift correction curve of the valve-closing cam, formed by the first and second ramp sections of the basic valve lift curve of the valve-closing cam being offset in the valve-lift-amount increasing direction; the first and second shift sections of the basic valve lift curve of the valve-closing cam; and the great lift section of the basic valve lift curve of the valve-closing cam; thus, the cam profile of the valve-closing cam is set on the basis of the normal valve lift curve of the valve-closing cam.

In the great lift section, the clearance between the normal valve lift curves of the valve-opening and valve-closing cams can be increased by the great lift section of the basic valve lift curve of the valve-opening cam being offset in the valve-lift-amount decreasing direction. In the first and second ramp sections, the clearance between the normal valve lift curves of the valve-opening and valve-dosing cams can be increased by the first and second ramp sections of the basic valve lift curve of the valve-closing cam being offset in the valve-lift-amount increasing direction. Thus, the clearance has to be managed with high accuracy only in the first and second shift sections; namely, the clearance need not be managed with high accuracy in the other sections than the first and second shift sections. Consequently, high machining or manufacturing accuracy and assembling accuracy is required of the various component parts of the valve operating device, which can thereby achieve significant cost reduction of the internal combustion engine. Further, with the increased clearance, the present invention can reduce the viscosity resistance and agitation resistance of the lubricating oil between the valve-opening and valve-closing cams and the corresponding follower and thereby enhance the performance, such as the output and fuel efficiency, of the internal combustion engine.

According to a second aspect of the present invention, a valve lift amount difference is provided between a basic valve lift curve of a valve-opening cam indicative of a relationship between the cam rotation angles and valve lift amounts of the valve-opening cam and a basic valve lift curve of a valve-closing cam indicative of relationship between the cam rotation angles and valve lift amounts of the valve-closing cam. There are set, with respect to the basic valve lift curves of the valve-opening and valve-closing cams, ultimate valve lift curves of the valve-opening and valve-closing cams each including, as cam rotation angle ranges, a first shift section where a corresponding one of the followers for actuating the air intake valve and exhaust valve jumps away from the valve-opening cam and lands on the valve-closing cam and a second shift section where the follower jumps away from the valve-closing cam and lands on the valve-opening cam. Basic speed difference is determined which is indicative of a difference between jumping and landing speeds of the follower on a basic valve speed curve determined from the basic valve lift curves of the valve-opening and valve-closing cams, and an ultimate speed difference is determined which is indicative of a difference between jumping and landing speeds of the follower on an ultimate valve speed curve determined from the ultimate valve lift curves of the valve-opening and valve-closing cams. The respective cam profiles of the valve-opening and valve-closing cams are set in such a manner that the ultimate speed difference is smaller than the basic speed difference.

The first and second shift sections are provided on each of the ultimate valve lift curves of the valve-opening and valve-closing cams. In the first shift section, the corresponding follower jumps away from the surface of the valve-opening cam and lands on the surface of the valve-closing cam, while, in the second shift section, the corresponding follower jumps away from the surface of the valve-closing cam and lands on the surface of the valve-opening cam. The basic valve speed curve is determined from the basic valve lift curves of the valve-opening and valve-closing cams, and the basic speed difference is determined which is indicative of the difference between the jumping and landing speeds of the follower on the basic valve speed curve. Further, the ultimate valve speed curve is determined from the ultimate valve lift curves of the valve-opening and valve-closing cams, and the cam profiles are set such that the ultimate speed difference between jumping and landing speeds of the follower on the ultimate valve speed curve is smaller than the basic speed difference. Thus, the speed at which the follower collides against the valve-closing or valve-opening cam can be reduced; as a consequence, the colliding impact and hence sound noise can be significantly reduced. Consequently, even if the clearance between the ultimate valve lift curves of the valve-opening and valve-closing cams is formed into a relatively great size, it is possible to reduce the speed at which the follower collides against the valve-opening or vale-closing cam in the first and second shift sections and thereby lessen the colliding compact; as a result, the present invention can suppress production of sound noise while minimizing the cost.

Preferably, the cam profiles are set in such a manner that, in the first and second shift sections, the absolute value of the valve speed at a peak of the ultimate valve speed curve is set to be smaller than the absolute value of the valve speed at a peak of the basic valve speed curve, and that the absolute values of the landing speeds on the ultimate valve speed curve in the first and second shift sections are kept at values higher speed-curve positions than the corresponding absolute values of the landing speeds on the basic valve speed curve. The peak of the basic valve speed curve corresponds to an inflexion point of the basic valve lift curve, and this inflexion point is a point where the follower jumps away from the valve-opening or valve-closing cam. Similarly, the peak of the ultimate valve speed curve corresponds to an inflexion point of the ultimate valve lift curve, and this inflexion point is a point where the follower jumps away from the valve-opening or valve-closing cam.

With the arrangement that, in the first and second shift sections, the absolute value of the valve speed at the peak of the ultimate valve speed curve is set to be smaller than the absolute value of the valve speed at the peak of the basic valve speed curve, the jumping speed on the ultimate valve speed curve can be limited appropriately. Further, with the arrangement that the absolute values of the landing speeds on the ultimate valve speed curve in the first and second shift sections are kept constant at respective values corresponding to higher speed-curve positions than the corresponding absolute values of the landing speeds on the basic valve speed curve—more specifically, the absolute value of the landing speed on the valve speed curve in the first shift section (positive speed region) is kept at a constant value greater than the corresponding absolute value of the landing speed of the basic valve speed curve while the absolute value of the landing speed on the valve speed curve in the second shift section (negative speed region) is kept at a constant value smaller than the corresponding absolute value of the landing speed of the basic valve speed curve—, the landing speed on the ultimate valve lift curve can be increased, so that the ultimate speed difference between the jumping speed and the landing speed can be reduced. As a result, the colliding speed at which the follower collides the valve-closing or valve-opening cam, and hence the colliding impact, cam can be significantly reduced.

According to a third aspect of the present invention, there is provided an improved method for setting cam profiles of valve-opening and valve-closing cams for forcibly driving an air intake valve and exhaust valve, which the comprises: a first step of plotting a basic valve lift curve on the basis of a predetermined lift amount required of the air intake valve or exhaust valve and a valve speed curve from the basic valve lift curve; a second step of determining a basic speed difference between a jumping speed and a landing speed, on the basic speed curve, when a corresponding one of followers for actuating the air intake valve and exhaust valve jump away from the valve-opening cam and land on the valve-closing cam or when the follower jumps away from the valve-closing cam and lands on the valve-opening cam, and plotting an improved valve speed curve such that an improved speed difference between jumping and landing speeds, on the improved valve speed curve, of the follower is smaller than the basic speed difference; a third step of adjusting integrated values of the valve speeds indicated by the improved valve speed curve to integrated values of the valve speeds indicated by the basic valve speed curve while maintaining the improved speed difference, to thereby obtain an ultimate valve speed curve; and a fourth step of plotting an ultimate valve lift curve on the basis of the ultimate valve speed curve.

With the second step of plotting the improved valve speed curve such that the improved speed difference is smaller than the basic speed difference, the colliding speed at which the follower collides against the valve-closing or valve-opening cam, and hence the colliding impact, can be significantly reduced. Further, with the third step of adjusting the integrated values of the valve speeds of the improved valve speed curve to the integrated values of the valve speeds of the basic valve speed curve while maintaining the improved speed difference, the shape of the ultimate valve lift curve can be adjusted to agree with or approach the shape of the basic valve lift curve, except in sections including a range where the follower jumps away from the valve-opening cam and lands on the valve-closing cam or where the follower jumps away from the valve-closing cam and lands on the valve-opening cam.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

Figure 1:
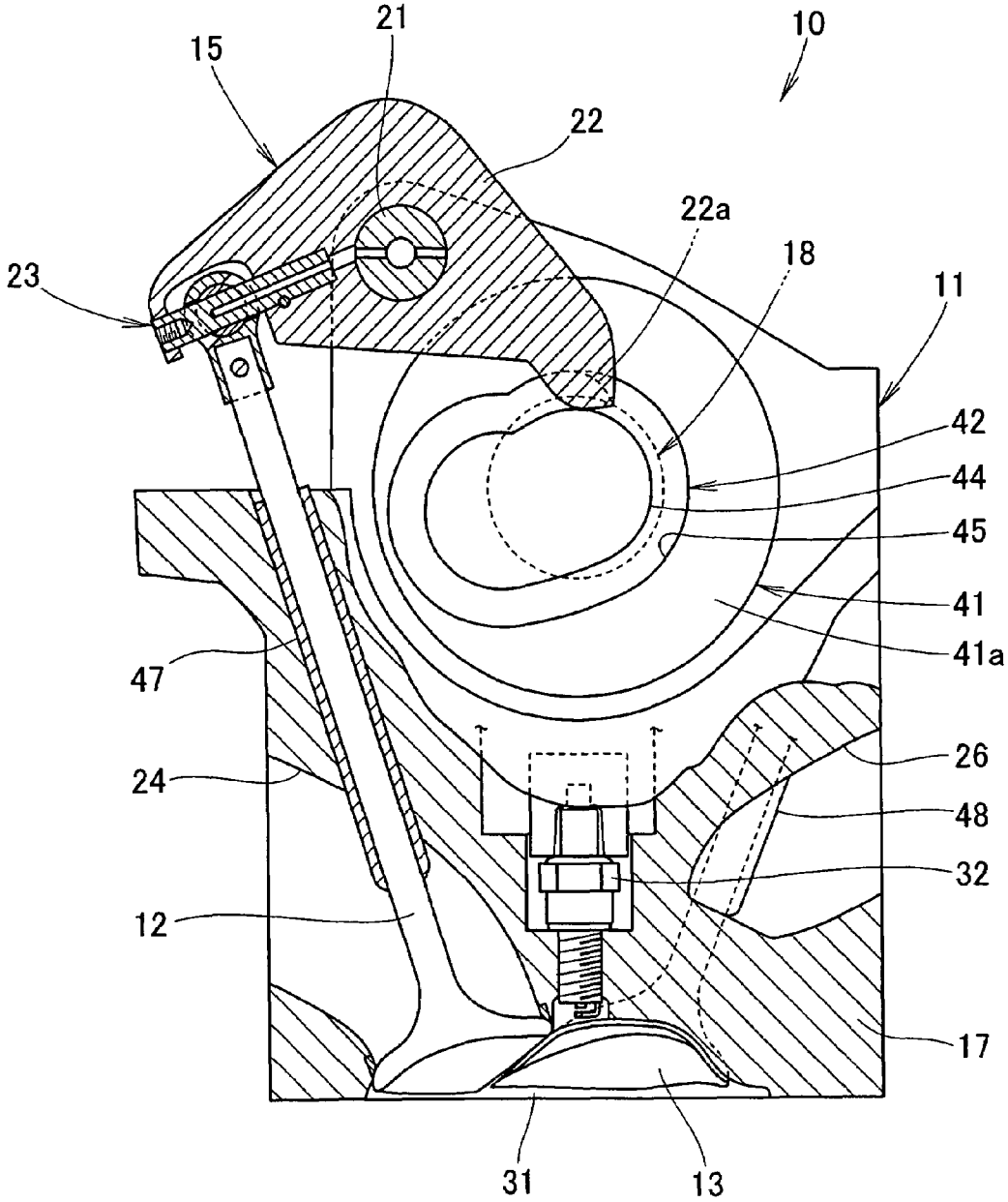
FIG. 1 is a sectional view showing a valve operating device for an internal combustion engine according to a first embodiment of the present invention.

FIG. 1 is a sectional view showing a valve operating device for an internal combustion engine according to a first embodiment of the present invention. The internal combustion engine 10 includes a cylinder head 11 that is provided with a valve operating device 15 of a forced-valve-opening/closing type that forcibly drives an air intake valve 12 and exhaust valve 13 to open and close the valves 12 and 13.

The valve operating device 15 includes a cam shaft 18 rotatably mounted on a cylinder head body 17, a rocker shaft 21 mounted on the cylinder head body 17, a rocker arm pivotably mounted on the rocker shaft 21 and drivable by the cam shaft 18, the air intake valve 12 connected via a connection mechanism 23 to an end of the rocker arm 22 for opening and closing an air intake port 24 of the cylinder head body 17, and the exhaust valve 13 connected to an end of a rocker arm (not shown) for opening and closing an exhaust port 26 of the cylinder head body 17. Reference numeral 31 represents a combustion chamber communicating with the air intake port 24 and exhaust port 26, and 32 represents an ignition plug projecting into the combustion chamber 31.

The cam shaft 18 has a disk section 41 formed thereon in such a manner as to intersect the axis of the shaft 18, and a cam groove section 42 is formed in a surface 41*a* of the disk section 41.

Cam follower 22*a* formed at the distal end of the rocker arm 22 is inserted in the cam groove 42, and the cam groove section 42 has a valve-opening cam 44 for opening the air intake valve 12 and a valve-closing cam 45 for closing the air intake valve 12. The valve-opening cam 44 and valve-closing cam 45 slidingly contact the above-mentioned follower 22*a*. Reference numerals 47 and 48 represent valve guides. Separate followers 22*a* are provided in corresponding relation to the air intake vale 12 and exhaust valve 13.

Figure 2:
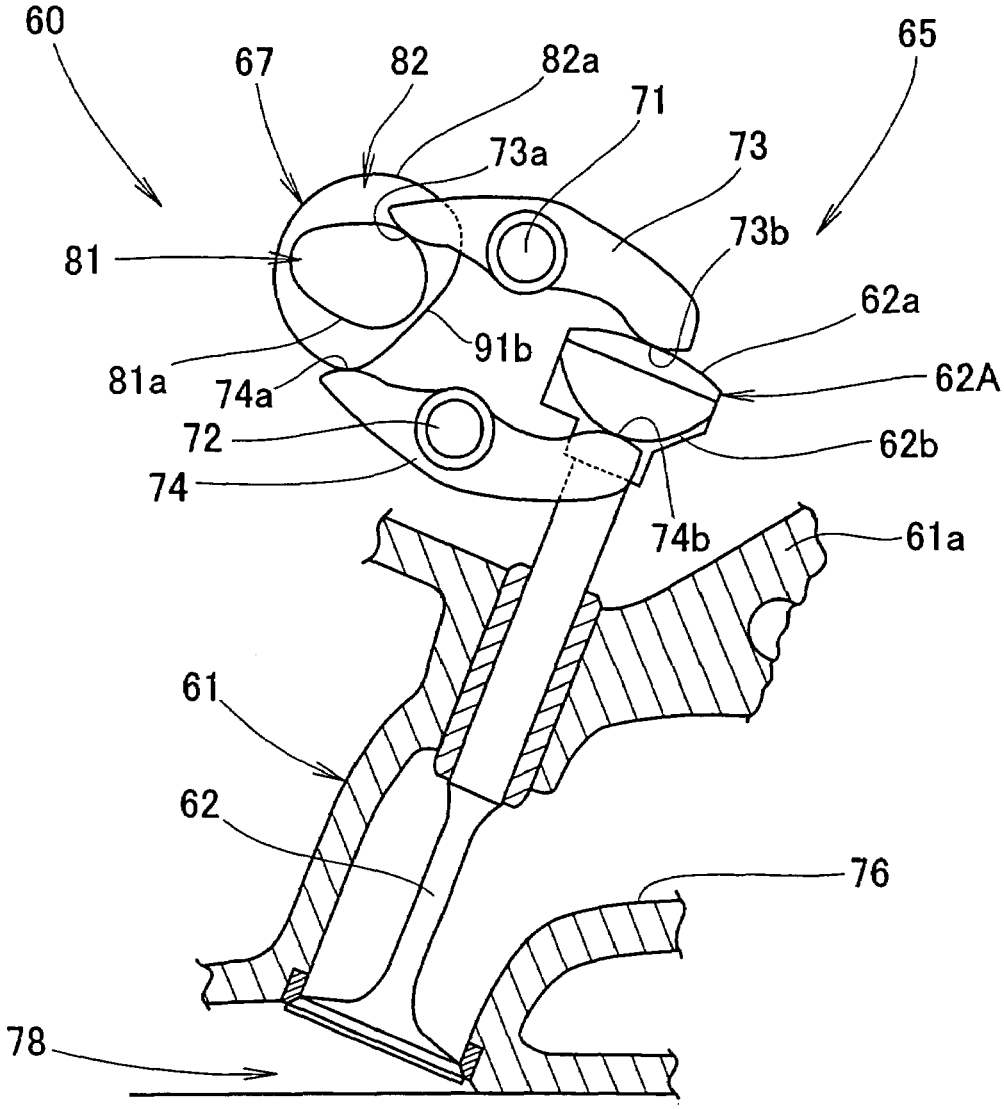
FIG. 2 is a sectional view showing a valve operating device for an internal combustion engine according to a second embodiment of the present invention.

FIG. 2 is a sectional view showing a valve operating device for an internal combustion engine according to a second embodiment of the present invention. The internal combustion engine 60 includes a cylinder head 61 provided with a valve operating device 65 of a forced-valve-opening/closing type that forcibly drives an air intake valve 62 to open and close the valve 62.

The valve operating device 65 includes a cam shaft 67 rotatably mounted on a cylinder head body 61*a*, rocker shafts 71 and 72 mounted on the cylinder head body 61*a*, a valve-opening rocker arm 73 and valve-closing rocker arm 74 pivotably mounted on the rocker shafts 71 and 72 and driveable by the cam shaft 67, and the air intake valve 62 driveable by the rocker arms 73 and 74 for opening and closing the air intake port 76. Reference numeral 78 represents a combustion chamber that communicates with the air intake port 76 when the air intake valve 62 is opened.

The cam shaft 67 is provided with a valve-opening cam 81 for driving the valve-opening rocker arm 73, and a valve-closing cam 82 for driving the valve-closing rocker arm 74. Reference numeral 81*a* represents a valve-opening cam surface slidingly contacting the valve-opening rocker arm 73, and 82*a* represents a valve-opening cam surface slidingly contacting the valve-closing rocker arm 74.

The valve-opening rocker arm 73 has a cam-side sliding surface 73*a* slidingly contacting the valve-opening cam 81, and a valve-side sliding surface 73*b* slidingly contacting an end section 62A of the air intake valve 62.

The valve-closing rocker arm 74 has a cam-side sliding surface 74*a* slidingly contacting the valve-closing cam 82, and a valve-side sliding surface 74*b* slidingly contacting the end section 62A of the air intake valve 62.

The end section 62A of the air intake valve 62 has a valve-opening-side sliding surface 62*a* that slidingly contacts the valve-side sliding surface 73*b* of the valve-opening rocker arm 73, and a valve-closing-side sliding surface 62*b* that slidingly contacts the valve-side surface 74*b* of the valve-closing rocker arm 74.

In the instant embodiment, the end section 62A of the air intake valve 62 corresponds in function to the follower 62*a* in the embodiment of FIG. 1.

Figure 3:
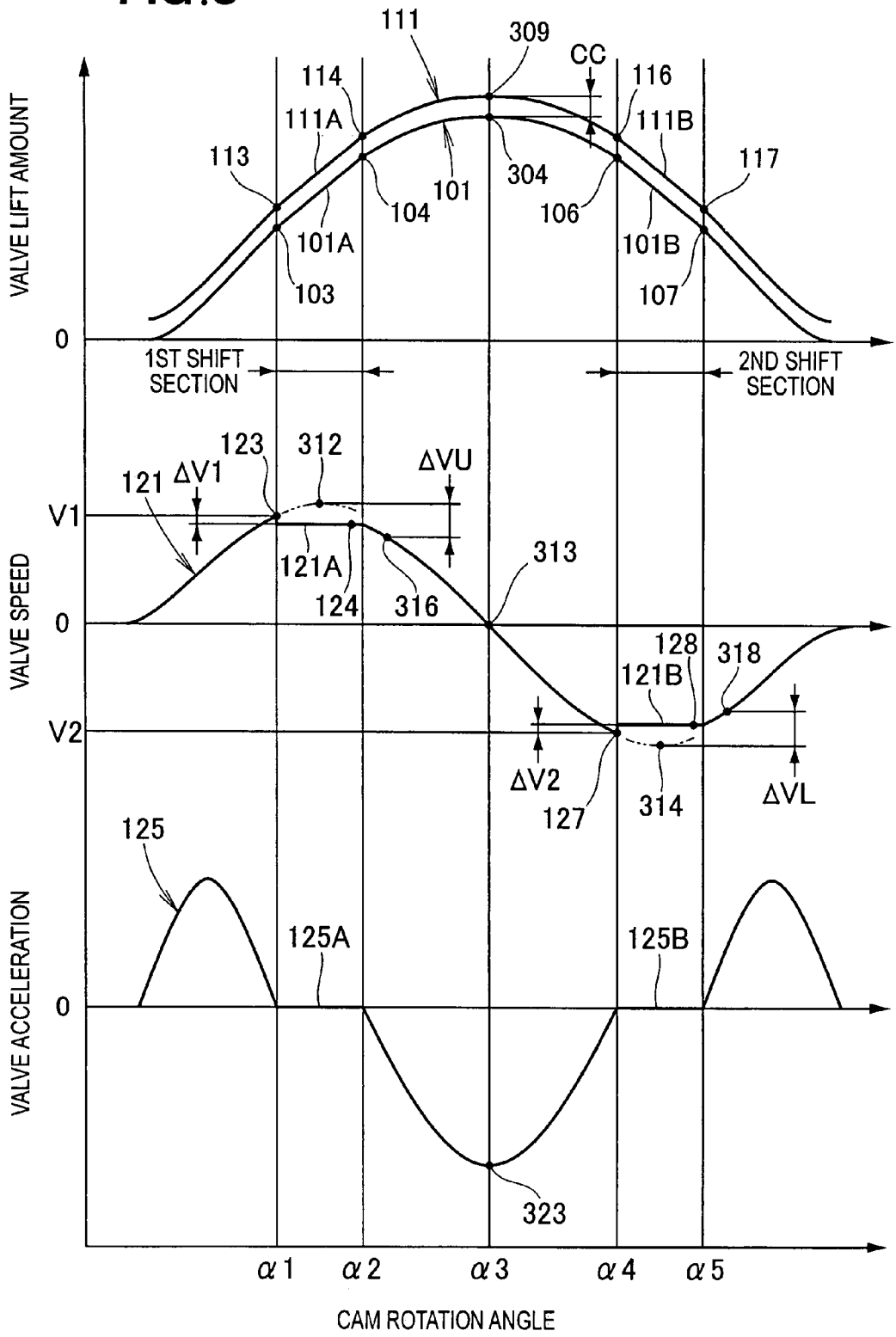
FIG. 3 is a graph showing valve lift amounts, valve speed and valve acceleration related to the valve-opening and valve-closing cams of the present invention.
Figure 13:
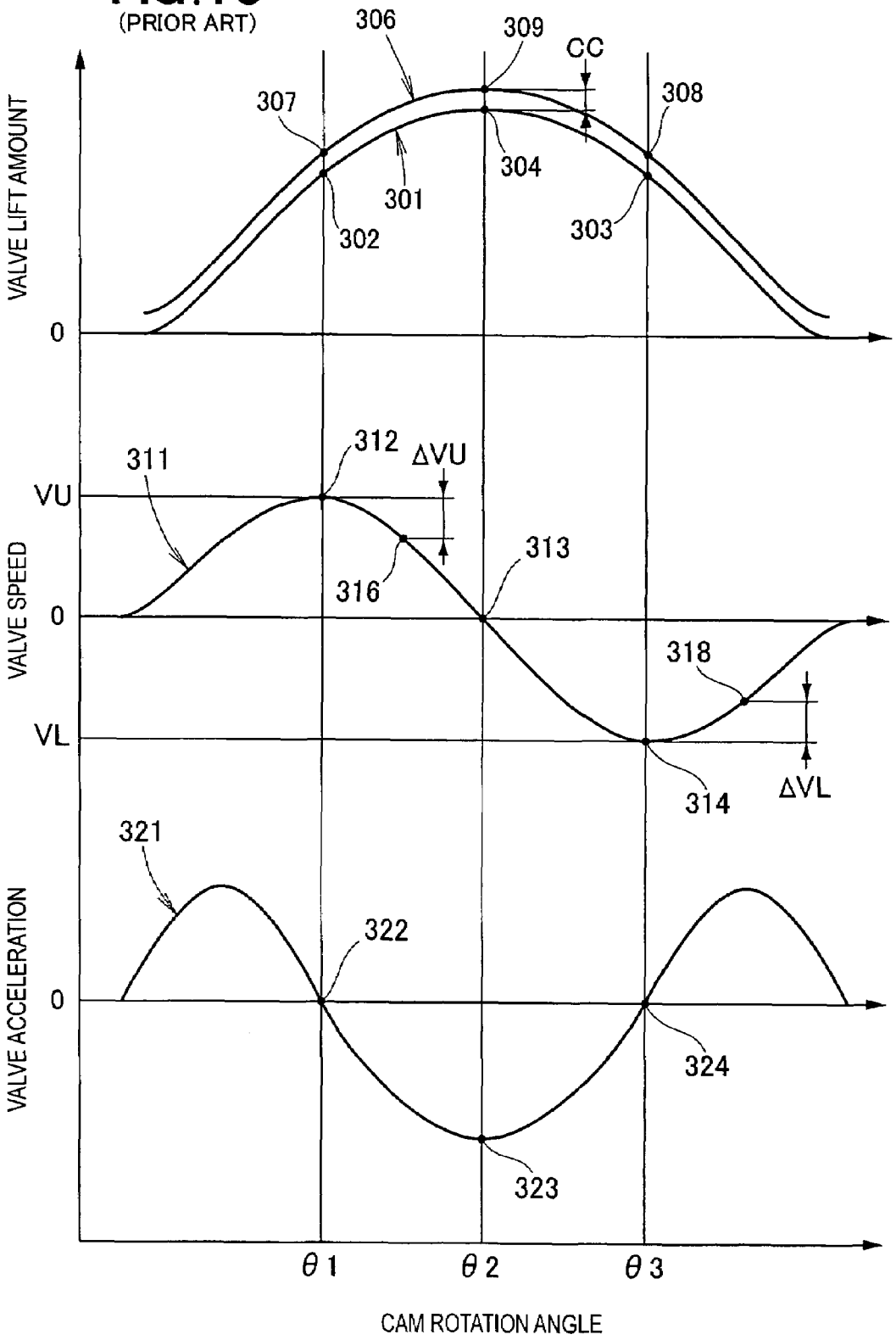
FIG.13 (PRIOR ART)
FIG. 13 is a graph showing relationship between a cam rotation angle and valve lift amounts of conventionally-known valve-opening and valve-closing cams.

FIG. 3 is a graph showing valve lift amounts, valve speed and valve acceleration related to the valve-opening and valve-closing cams of the present invention, for example, in the case where the air intake valve 12 is opened and closed via the valve-opening cam 44 and valve-closing cam 45 shown in FIG. 1. In FIG. 3, the same elements as in FIG. 13 are indicated by the same reference characters as used in FIG. 13 and will not be described in detail to avoid unnecessary duplication. In FIG. 3, the vertical axis represents the valve lift amounts, valve speeds determined by one of the valve lift amounts and valve acceleration determined by the valve speed, while the horizontal axis represents the cam rotation angles.

Valve lift curve 101 of the valve-opening cam is different from the valve lift curve 301 of FIG. 13 in that it has modified portions, i.e. slanted linear portions 101A and 101B, in cam rotation angle ranges $\alpha 1$-$\alpha 2$ and $\alpha 4$-$\alpha 5$. These slanted linear portions 101A and 101B have, at their opposite ends, inflexion points 103 and 104 and inflexion points 106 and 107, respectively.

Valve lift curve 111 of the valve-closing cam is different from the valve lift curve 306 of FIG. 13 in that it has modified portions, i.e. slanted linear portions 111A and 111B, in the cam rotation angle ranges $\alpha 1$-$\alpha 2$ and $\alpha 4$-$\alpha 5$. These slanted linear portions 111A and 111B have, at their opposite ends, inflexion points 113 and 114 and inflexion points 116 and 117, respectively.

The cam rotation angle range $\alpha 1$-$\alpha 2$ in the valve lift curve 101 and 111 will hereinafter be referred to as "first shift section", while the cam rotation angle range $\alpha 4$-$\alpha 5$ in the valve lift curves 101 and 111 will hereinafter be referred to as "second shift section". The above-mentioned slanted linear portions 101A and 111A are parallel to each other, and slanted linear portions 101B and 111B are parallel to each other.

Figure 14:
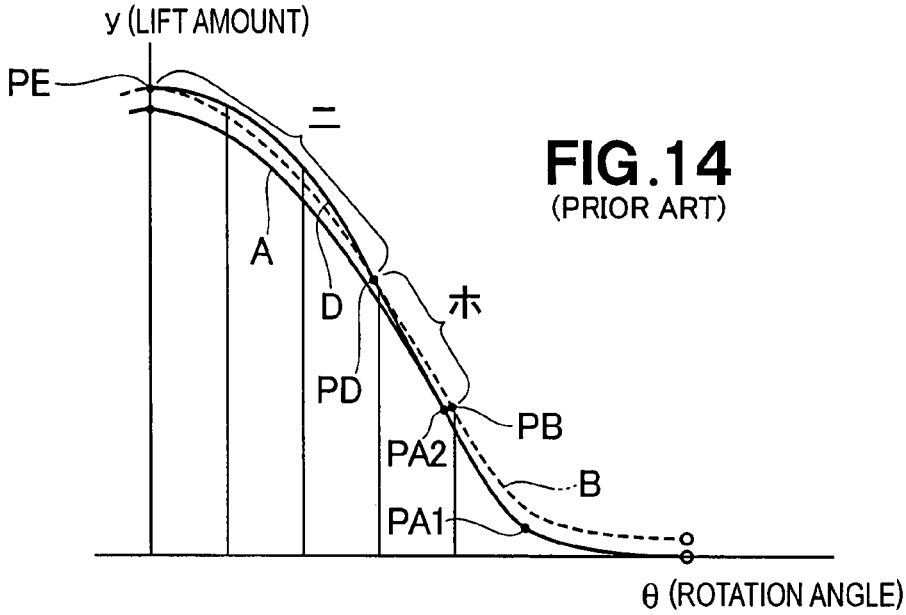
FIG.14 (PRIOR ART)
FIG. 14 is a graph showing relationship between a cam rotation angle and valve lift amounts in a conventionally-known valve operating device for an internal combustion engine.
Figure 15:
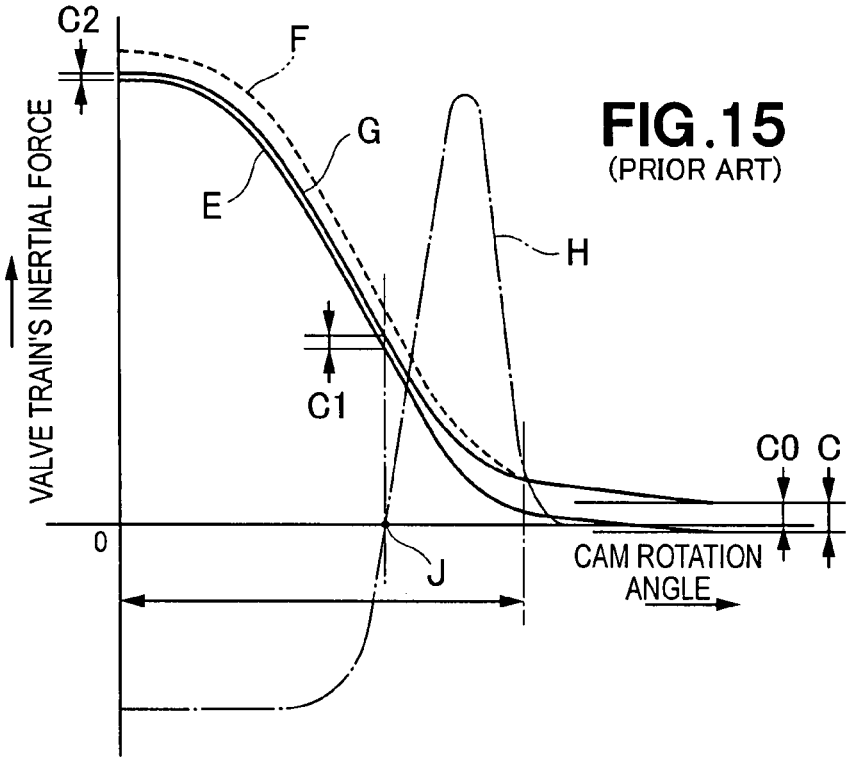
FIG.15 (PRIOR ART)
FIG. 15 is a graph showing a relationship between valve lift amounts and valve train's inertial force and cam rotation angle in a conventionally-known valve operating device for an internal combustion engine.

Valve lift amount difference, i.e. clearance CC, between the valve lift curves 101 and 111 is, for example, 0.1 mm, and the same clearance CC is set in the first shift section and second shift section. Namely, in the instant embodiment, the clearance CC between the valve lift curves 101 and 111 in the first and second shift sections is greater than the clearance in the conventionally-known device shown in FIG. 14 or 15, so that component parts of the valve operating device may have lower machining or manufacturing and assembling accuracy. In this way, the instant embodiment can not only reduce the necessary cost of the internal combustion engine but also reduce viscosity and agitation resistance when the follower slides over the valve-opening or valve-closing cam surface, so that output loss of the internal combustion engine can be effectively reduced.

The above-mentioned cam rotation angle range α1-α2 is a range where the inflexion points 302 and 307 of the valve lift curves 301 and 306 of FIG. 13 are present, and the above-mentioned cam rotation angle range α4-α5 is a range where the inflexion points 303 and 308 of the valve lift curves 301 and 306 of FIG. 13 are present.

The cam rotation angle range α1-α2 in the valve speed curve 121 obtained by differentiating the valve lift curve 101 or 111 is in the form of a horizontal linear section 121A, and the cam rotation angle range α4-α5 in the valve speed curve 121 obtained by differentiating the valve lift curve 101 or 111 is in the form of a horizontal linear section 121B.

The horizontal linear section 121A is where the valve speed is kept at a constant value lower than the peak in the positive-speed region of the valve speed curve 121, i.e. the peak in the positive-speed regions or maximum speed point 312 of the valve speed curve 311 of FIG. 13.

The horizontal linear section 121B is where the valve speed is maintained at a constant absolute value lower than the peak in the negative-speed region of the valve speed curve 121, i.e. the peak in the negative-speed region or minimum speed point 314 of the valve speed curve 311 of FIG. 13.

In FIG. 3, reference numeral 123 represents a jumping point where the follower (i.e., follower 22*a* of FIG. 1 or end section 62A of FIG. 2) moves or jumps away from (i.e., disengages from) the cam surface of the valve-opening cam, and which is located at the point of the cam rotation angle α1 on the valve speed curve 121. This jumping point is a peak point where the valve speed takes the greatest value V1 in the positive-speed region of the valve speed curve 121. Further, reference numeral 124 represents a landing point where the follower lands on the valve-closing cam surface, and which is located on the horizontal linear section 121A. These jumping point 123 and landing point 124 will be later explained in greater detail with reference to FIG. 4.

Difference between a jumping speed of the follower (valve speed) at the jumping point 123 and a landing speed of the follower (valve speed) at the landing point 124 is indicated by ΔV1.

In the instant embodiment, the valve speed V1 at the jumping point 123 is set to be lower than a valve speed at the jumping point 312 (see also FIG. 13) and the valve speed at the landing point 124 is set to be higher than a valve speed at the landing point 316 (see also FIG. 13), so that the speed difference ΔV1 is smaller than the speed difference ΔVU.

Similarly, in FIG. 3, reference numeral 127 represents a jumping point where the follower moves or jumps away from the cam surface of the valve-closing cam, and which is located at the cam rotation angle α4 on the valve speed curve 121. This jumping point is a peak point where the absolute value of the valve speed takes the greatest value V2 in the negative-speed region of the valve speed curve 121. Further, reference numeral 128 represents a landing point where the follower lands on the valve-opening cam surface, and which is located on the horizontal linear section 121B. These jumping point 127 and landing point 128 will be later explained in greater detail with reference to FIG. 4.

Difference between a jumping speed of the follower at the jumping point 127 and a landing speed of the follower at the landing point 128 is indicated by ΔV2.

In the instant embodiment, the absolute value of the valve speed V2 at the jumping point 127 is set to be lower than the absolute value of a valve speed at the jumping point 314 (FIG. 13) and the absolute value of the valve speed at the landing point 128 is set to be higher than the absolute value of a valve speed at the landing point 318 (FIG. 13), so that the speed difference ΔV2 is set to be smaller than the speed difference ΔVL of FIG. 13.

The valve acceleration curve 125 obtained by differentiating the valve speed curve 121 has, in the cam rotation angle range α1-α2, a linear section 125A where the valve acceleration is kept constant at a zero value in correspondence with the linear section 121A of the valve speed curve 121, and has, in the cam rotation angle range α4-α5, a linear section 125B where the valve acceleration is kept constant at a zero value in correspondence with the linear section 121B of the valve speed curve 121.

Figure 4:
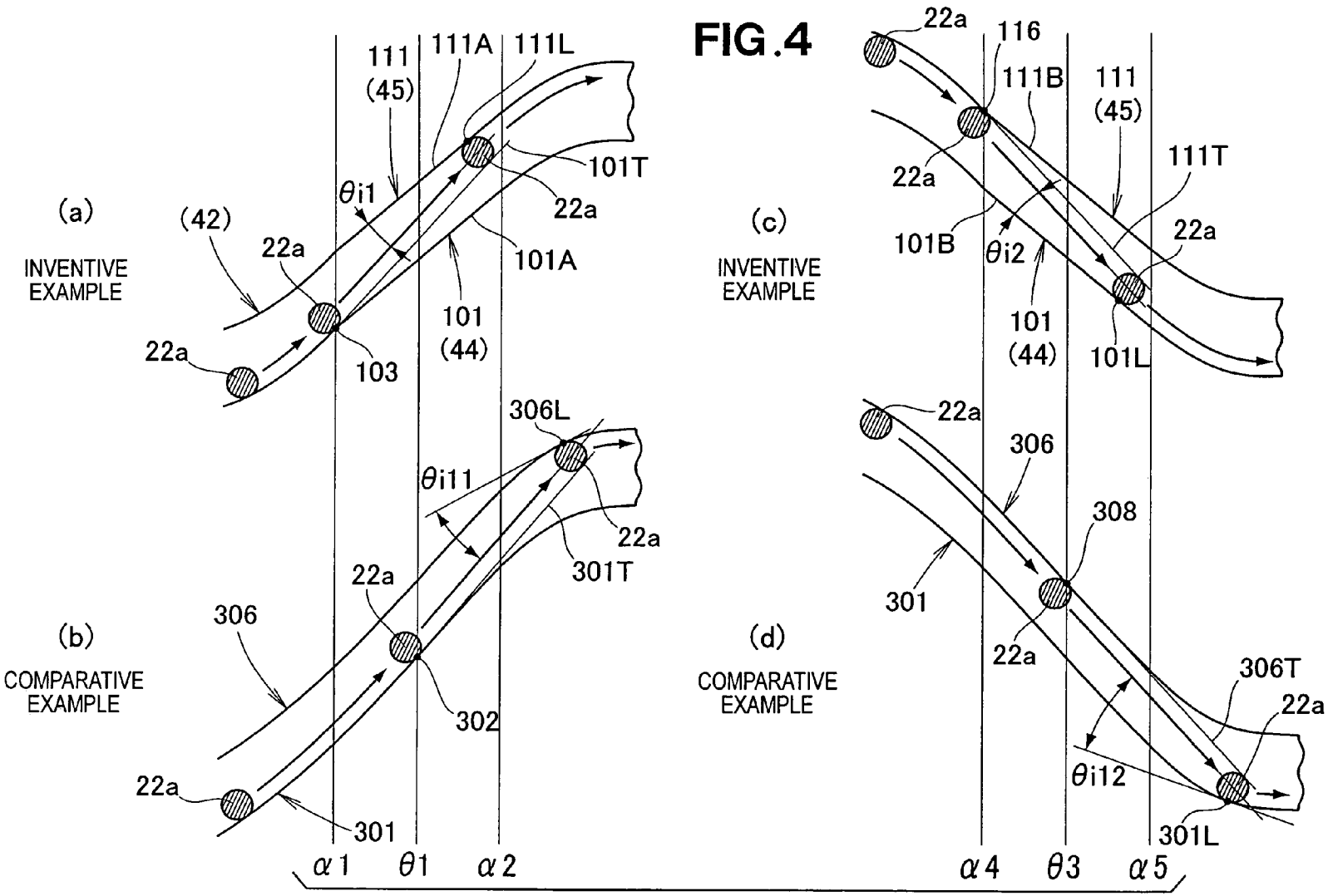
FIG. 4 is a diagram explanatory of operation of the valve lift curves of the valve-opening cam and valve-closing cam of the present invention.

FIG. 4 is a diagram explanatory of operation of the examples of the valve lift curves of the valve-opening cam and valve-closing cam of the present invention. More specifically, (a) and (c) of FIG. 4 show, as inventive examples, the cam rotation angel ranges α1-α2 and α4-α5 in the present invention, and (b) and (d) show, as comparative examples, sections centered around cam rotation angles θ1 and θ3 of the valve lift curves 301 and 306 of FIG. 13.

In the inventive example shown in (a) of FIG. 4, the valve lift curves 101 and 111 are regarded as the cam groove section 42 shown in FIG. 1; more specifically, in (a) of FIG. 4, the valve lift curve 101 is considered to be the valve-opening cam 44 while the valve lift curve 111 is considered to be the valve-closing cam 45, and the follower 22*a* of the rocker arm 22 of FIG. 1 is represented by hatched circular marks. Whereas, in effect, the follower 22*a* moves in a direction substantially normal to the cam groove section 42 (i.e., perpendicular to the sheet of the figure) as the cam groove section 42 moves, let it be assumed here, for convenience of description, that the valve lift curves 101 and 111 are kept stationary and the follower 22*a* moves between the valve lift curves 101 and 111.

Once the follower 22*a* reaches the inflexion point 103 while sliding along the valve lift curve 101 of the valve-opening cam 44 as indicated by arrows, it moves away from the inflexion point 103 at the jumping speed V1 (see FIG. 3) but continues to move, by an inertial force, along a tangential line 101T at the inflexion point 103 so that it lands on a point 111L of the linear portion 111A of the valve lift curve 111.

In the comparative example shown in (b) of FIG. 4, the valve lift curves 301 and 306 are regarded as a cam groove section; more specifically, in (b) of FIG. 4, the valve lift curve 301 is considered to be the valve-opening cam while the valve lift curve 306 is considered to be the valve-closing cam. Let it be assumed here, for convenience of description, that the follower 22*a* moves between the valve lift curves 301 and 306.

Once the follower 22*a* reaches the inflexion point 302 while sliding along the valve lift curve 301 of the valve-opening cam as indicated by arrows, it moves away from the inflexion point 302 at the jumping speed VU (see FIG. 13) but continues to move, by an inertial force, along a tangential line 301T at the inflexion point 302 so that it lands on a point 306L of the valve lift curve 306.

In the inventive example shown in (c) of FIG. 4, once the follower 22*a* reaches an inflexion point 116 while sliding along the valve lift curve 111 of the valve-closing cam 45 as indicated by arrows, it moves away from the inflexion point 116 at the jumping speed V2 (see FIG. 3) but continues to move, by an inertial force, along a tangential line 111T at the inflexion point 116 so that it lands on a point 101L of the linear portion 101B.

In the comparative example shown in (d) of FIG. 4, once the follower 22*a* reaches the inflexion point 308 while sliding along the valve lift curve 306 of the valve-closing cam as indicated by arrows, it moves away from the inflexion point 308 at the jumping speed VL (see FIG. 13) but continues to move, by an inertial force, along a tangential line 306T at the inflexion point 308 so that it lands on a point 301L of the valve lift curve 301.

More specifically, the following operation takes place in the inventive example shown in (a) of FIG. 4 and in the comparative example shown in (b) of FIG. 4. In the comparative example shown in (b) of FIG. 4, the follower 22*a* moves away from the valve lift curve 301 at the inflexion point 302, which means that the follower 22*a* leaves the valve lift curve 301 at the maximum valve speed point. Thus, the follower 22*a* leaves the valve lift curve 301 at the maximum jumping speed VU and then lands on the valve lift curve 306 while almost maintaining the same jumping speed VU. But, actually, during the time that the follower 22*a* leaves the valve lift curve 301 and lands on the valve lift curve 306, the speed of the valve lift curve 306 (namely, valve speed of the valve-closing cam) gradually decreases, and the landing speed, at which the follower 22*a* lands on the valve lift curve 306 at a point where the cam rotation angle has advanced from the angle α2, is considerably lower than the jumping speed VU as seen in FIG. 13. Thus, the difference ΔVU between the jumping speed and the landing speed, i.e. the speed (colliding speed) at which the follower 22*a* collides against the valve lift curve 306 increases, which would thus result in an increased colliding impact.

Further, the follower 22*a* lands on the valve lift curve 306 at a great incidence angle θi11, and thus, a valve speed component of the follower 22*a*, perpendicular to the colliding surface of the valve lift curve 306, increases, which would also increase the colliding impact.

By contrast, in the inventive example shown in (a) of FIG. 4, where the follower 22*a* leaves the valve lift curve 101 at the inflexion point 103 where the cam rotation angle is smaller than that at the inflexion point 302 in the comparative example ((b) of FIG. 4), the jumping speed V1 (see FIG. 3) of the follower 22*a* is smaller than the jumping speed in the comparative example. The follower 22*a* lands on the linear portion 111A of the valve lift curve 111 with the same jumping speed V1 maintained almost throughout the movement of the follower 22*a*. Actually, however, the speed of the valve lift curve 111 (namely, valve speed of the valve-closing speed 45) changes during the time that the follower 22*a* jumps away from the valve lift curve 101 and lands on the valve lift curve 111, and thus, when the follower 22*a* lands on the linear portion 111A at the point preceding the point of the cam rotation angle α2, the landing speed of the follower 22*a* merely becomes slightly lower than the jumping speed, so that the difference ΔV1 between the jumping speed and the landing speed, i.e. the speed (colliding speed) at which the follower 22*a* collides against the linear portion 111A is reduced as compared to that in the comparative example shown in (b) of FIG. 4; as a consequence, the colliding impact and hence sound noise can be significantly reduced.

Further, the follower 22*a* lands on the linear portion 111A of the valve lift curve 111 at an incidence angle θi1 smaller than the incidence angle θi11 in the comparative example shown in (b) of FIG. 4, and thus, the valve speed component of the follower 22*a*, perpendicular to the colliding surface of the valve lift curve 111, can be reduced as compared to that in the comparative example, which can also lower the colliding impact as compared to the comparative example.

The cam rotation angle range α1-α2 in the aforementioned example will hereinafter be referred to as "first shift section" because the follower 22*a* shifts from the valve lift curve 101 to the valve lift curve 111.

Similar operation takes place in the inventive example shown in (c) of FIG. 4 and in the comparative example shown in (d) of FIG. 4. Namely, in the comparative example shown in (d) of FIG. 4, the follower 22*a* moves away from the valve lift curve 306 at the inflexion point 308, which means that the follower 22*a* leaves the valve lift curve 306 at a point where the absolute value of the valve speed is maximum as shown in FIG. 13. Thus, the absolute value of the jumping speed VL of the follower 22*a* becomes maximum, and the follower 22*a* then lands on the valve lift curve 301 while almost maintaining the jumping speed VL. But, actually, during the time that the follower 22*a* leaves the valve lift curve 306 and lands on the valve lift curve 301, the speed of the valve lift curve 301 (namely, valve speed of the valve-opening cam) gradually decreases, and the absolute value of the landing speed, at which the follower 22*a* lands on the valve lift curve 301 at a point where the cam rotation angle has advanced from the angle α5, is considerably lower than the absolute value of the jumping speed VL as seen in FIG. 13. Thus, the difference ΔVL between the absolute values of the jumping speed and landing speed, i.e. the speed (colliding speed) at which the follower 22*a* collides against the valve lift curve 301 increases which would result in an increased colliding impact.

Further, the follower 22*a* lands on the valve lift curve 301 at a great incidence angle θi12, and thus, a valve speed component of the follower 22*a*, perpendicular to the colliding surface of the valve lift curve 301, increases, which would also increase the colliding impact.

By contrast, in the inventive example shown in (c) of FIG. 4, where the follower 22*a* leaves the valve lift curve 111 at the inflexion point 116 where the cam rotation angle is smaller than that at the inflexion point 308 in the comparative example ((b) of FIG. 4), the absolute value of the jumping speed V2 is smaller than the absolute value of the jumping speed in the comparative example. The follower 22*a* lands on the linear portion 101B of the valve lift curve 101 with the same jumping speed V2 almost maintained throughout the movement of the follower 22*a*. Actually, however, the speed of the valve lift curve 101 (namely, valve speed of the valve-opening speed 44) changes during the time that the follower 22*a* jumps away from the valve lift curve 111 and lands on the valve lift curve 101, and thus, when the follower 22*a* lands on the linear portion 101B at the point preceding the cam rotation angle α5, the landing speed of the follower 22*a* merely becomes slightly lower than the jumping speed, so that the difference ΔV2 between the jumping speed and the landing speed, i.e. the speed (colliding speed) at which the follower 22*a* collides against the linear portion 101B is reduced as compared to that in the comparative example shown in (d) of FIG. 4; as a consequence, the colliding impact and hence sound noise can be significantly reduced.

Further, the follower 22*a* lands on the linear portion 101B of the valve lift curve 101 at an incidence angle θi2 smaller than an incidence angle θi12 in the comparative example shown in (d) of FIG. 4, and thus, the valve speed component of the follower 22*a*, perpendicular to the colliding surface, can be reduced as compared to that in the comparative example, which can also lower the colliding impact as compared to the comparative example.

The cam rotation angle range α4-α5 in the aforementioned example will hereinafter be referred to as "second shift section" because the follower 22*a* shifts from the valve lift curve 111 to the valve lift curve 101.

Figure 5:
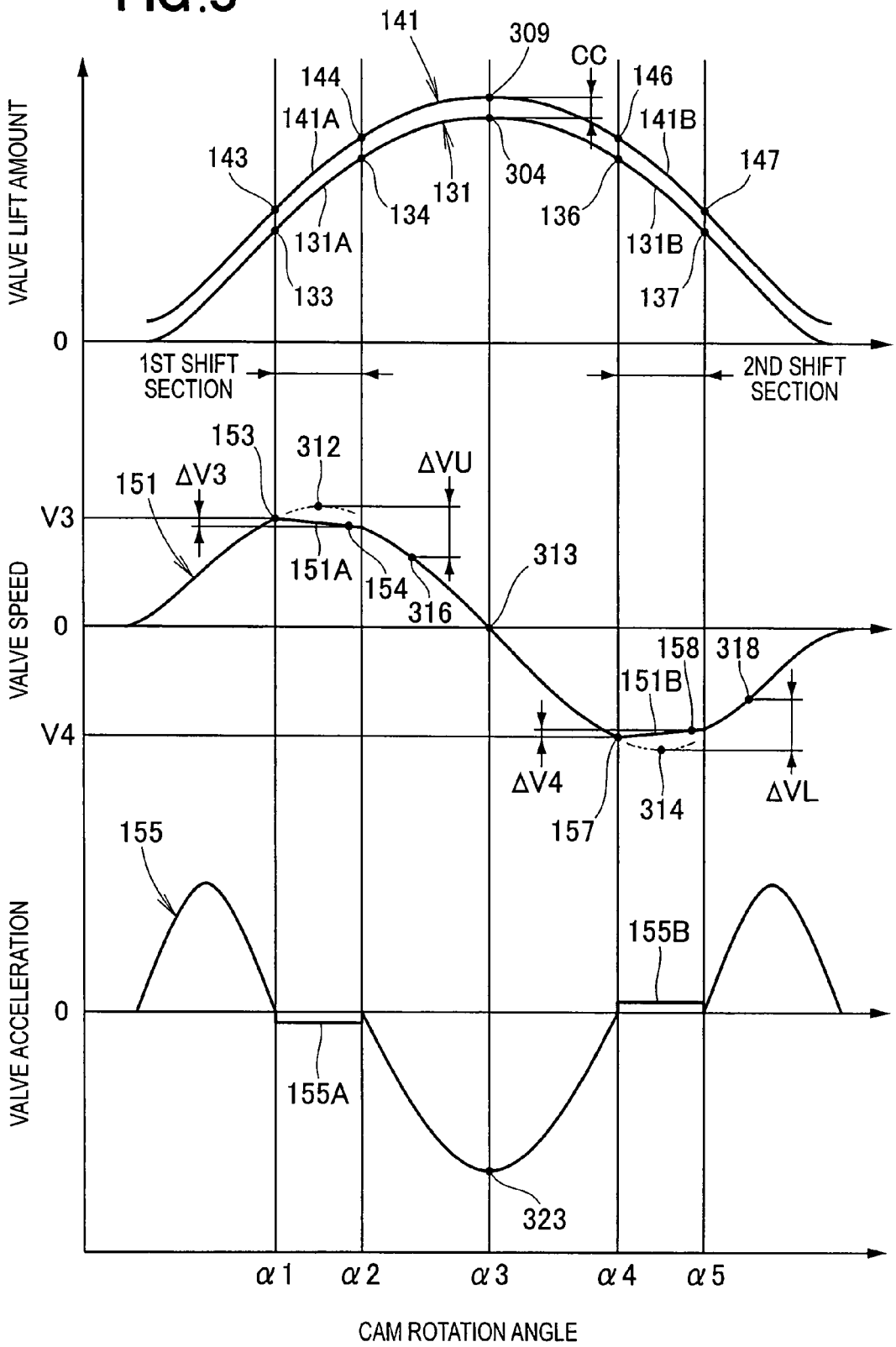
FIG. 5 is a graph showing other examples of the valve lift amounts, valve speed and valve acceleration related to the valve-opening and valve-closing cams of the present invention.

FIG. 5 is a graph showing other examples of the valve lift amounts, valve speed and valve acceleration related to the valve-opening and valve-closing cams of the present invention, for example, in the case where the air intake valve 12 is opened and closed via the valve-opening cam 44 and valve-closing cam 45 of FIG. 1. In FIG. 5, the same elements as in FIG. 13 are indicated by the same reference characters as used in FIG. 13 and will not be described in detail. In FIG. 5, the vertical axis represents the valve lift amounts, valve speeds determined by one of the valve lift amounts and valve acceleration determined by the valve speed, while the horizontal axis represents the cam rotation angles.

The valve lift curve 131 of the valve-opening cam is different from the valve lift curve 301 of FIG. 13 in that it has modified portions, i.e. second-order curved portions 131A and 131B, in the cam rotation angle range $\alpha 1$-$\alpha 2$ (i.e., first shift section) and in the cam rotation angle range $\alpha 4$-$\alpha 5$ (i.e., second shift section). These second-order curved portions 131A and 131B have, at their opposite ends, inflexion points 133 and 134 and inflexion points 136 and 137, respectively.

The valve lift curve 141 of the valve-closing cam is different from the valve lift curve 306 of FIG. 13 in that it has modified portions, i.e. second-order curved portions 141A and 141B in the cam rotation angle range $\alpha 1$-$\alpha 2$ and in the cam rotation angle range $\alpha 4$-$\alpha 5$. These second-order curved portions 141A and 141B have, at their opposite ends, inflexion points 143 and 144 and inflexion points 146 and 147, respectively. The above-mentioned second-order curved portions 131A and 141A are parallel to each other, and the second-order curved portions 131B and 141B are parallel to each other.

The above-mentioned cam rotation angle range $\alpha 1$-$\alpha 2$ is a range where the inflexion points 302 and 307 of the valve lift curves 301 and 306 of FIG. 13 are included, and the above-mentioned cam rotation angle range $\alpha 4$-$\alpha 5$ is a range where the inflexion points 303 and 308 of the valve lift curves 301 and 306 of FIG. 13 are included.

The cam rotation angle range $\alpha 1$-$\alpha 2$ in the valve speed curve 151 obtained by differentiating the valve lift curve 131 or 141 is in the form of a slanted linear section 151A, and the cam rotation angle range $\alpha 4$-$\alpha 5$ in the valve speed curve 151 is in the form of a slanted linear section 151B.

The slanted linear section 151A is a portion where the valve speed is lower than the peak of the valve speed curve 151, i.e. lower than the maximum speed point 312 of the valve speed curve 311 (FIG. 13) and where the valve speed gradually decreases at a predetermined rate.

The slanted linear section 151B is a portion where the absolute value of the valve speed is lower than the peak in the negative-speed region of the valve speed curve 151, i.e. lower than the minimum speed point (i.e., peak in the negative-speed region) 314 of the valve speed curve 311 (FIG. 13) and where the absolute value of the valve speed gradually decreases at a predetermined rate.

In FIG. 5, reference numeral 153 represents a jumping point at which the follower (i.e., follower 22*a* (FIG. 1) or end section 62A (FIG. 2)) moves away from (i.e., disengages from) the cam surface of the valve-opening cam. The jumping point is located at the cam rotation angle $\alpha 1$ of the valve speed curve 151, and is a peak point where the valve speed takes the greatest value V3 in the positive-speed region of the valve speed curve 151. Further, reference numeral 154 represents a landing point where the follower lands on the valve-closing cam surface and which is located on the horizontal linear section 151A. These jumping point 153 and landing point 154 will be later explained in greater detail with reference to FIG. 6.

Difference between a jumping speed of the follower (valve speed) at the jumping point 153 and a landing speed of the follower (valve speed) at the landing point 154 is indicated by $\Delta V3$.

In the instant embodiment, the valve speed at the jumping point 153 is set to be lower than the valve speed at the jumping point 312 (see also FIG. 13) and the valve speed at the landing point 154 is set to be higher than the valve speed at the landing point 316 (see also FIG. 13), so that the speed difference $\Delta V3$ is smaller than the speed difference $\Delta VU$.

Similarly, in FIG. 5, reference numeral 157 represents a jumping point at which the follower moves away from the cam surface of the valve-closing cam. This jumping point is located at the point of the cam rotation angle $\alpha 4$ on the valve speed curve 151, and it is a peak point where the absolute value of the valve speed takes the greatest value V4 in the negative-speed region of the valve speed curve 151. Further, reference numeral 158 represents a landing point where the follower lands on the valve-opening cam surface and which is located on the slanted linear section 151B. These jumping point 157 and landing point 158 will be later explained in greater detail with reference to FIG. 6.

Difference between a jumping speed of the follower at the jumping point 157 and a landing speed of the follower at the landing point 158 is indicated by $\Delta V4$.

In the instant embodiment, the absolute value of the valve speed at the jumping point 157 is set to be smaller than the absolute value of the valve speed at the jumping point 314 (see also FIG. 13) and the absolute value of the valve speed at the landing point 158 is set to be higher than the absolute value of the valve speed at the landing point 318 (FIG. 13), so that the speed difference $\Delta V4$ is smaller than the speed difference $\Delta VL$.

The valve acceleration curve 155 obtained by differentiating the valve speed curve 151 has, in the cam rotation angle range $\alpha 1$-$\alpha 2$, a linear section 155A where the valve acceleration is kept constant at a negative value in correspondence with the linear section 151A of the valve speed curve 151, and has, in the cam rotation angle range $\alpha 4$-$\alpha 5$, a linear section 155B where the valve acceleration is kept constant at a positive value in correspondence with the linear section 151B of the valve speed curve 151.

Figure 6:
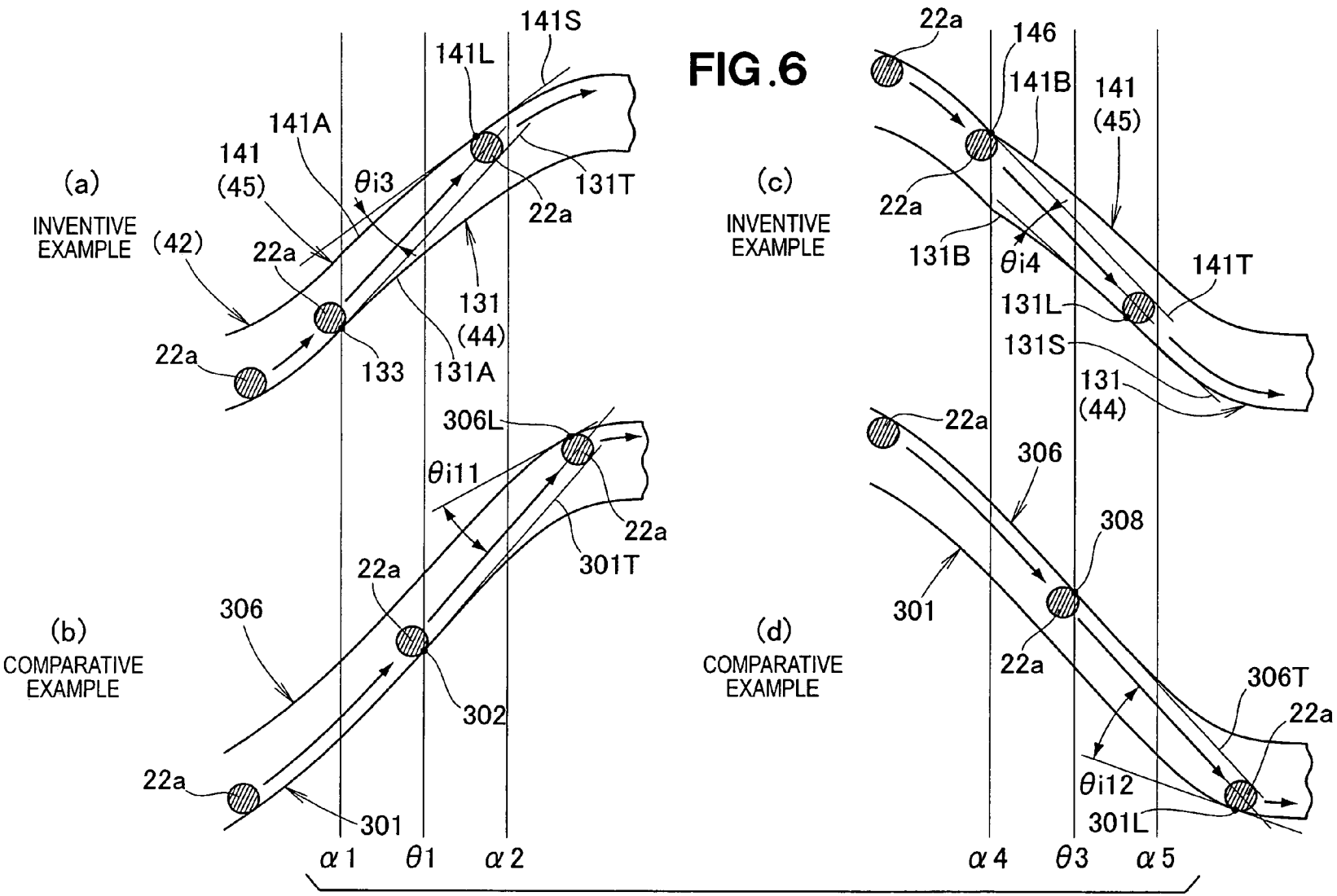
FIG. 6 is a diagram explanatory of operation of the other examples of the valve lift curves of the valve-opening cam and valve-closing cam of the present invention.

FIG. 6 is a diagram explanatory of operation of the other examples of the valve lift curves of the valve-opening cam and valve-closing cam of the present invention. More specifically, (a) and (c) of FIG. 6 show the cam rotation angel ranges $\alpha 1$-$\alpha 2$ and $\alpha 4$-$\alpha 5$ in enlarged scale, and (b) and (d) show, as comparative examples, sections centered around cam rotation angles $\theta 1$ and $\theta 3$ of the valve lift curves 301 and 306 of FIG. 13.

In the inventive example shown in (a) of FIG. 6, the valve lift curves 131 and 141 are regarded as the cam groove section 42 shown in FIG. 1; more specifically, in (a) of FIG. 6, the valve lift curve 131 is considered to be the valve-opening cam 44 while the valve lift curve 141 is considered to be the valve-closing cam 45, and the follower 22*a* of the rocker arm 22 of FIG. 1 is represented by hatched circular marks. Whereas, in effect, the follower 22*a* moves in the direction substantially normal to the cam groove section 42 (i.e., perpendicular to the sheet of the figure) as the cam groove section 42 moves, let it be assumed here, for convenience of description, that the valve lift curves 131 and 141 are kept stationary and the follower 22*a* moves between the valve lift curves 131 and 141.

Once the follower 22*a* reaches the inflexion point 133 while sliding along the valve lift curve 131 of the valve-opening cam 44 as indicated by arrows, it moves away from the inflexion point 133 at the jumping speed V3 (see FIG. 5) but continues to move, by an inertial force, along a tangential line 131T at the inflexion point 133 so that it lands on the portion 141A of the valve lift curve 141. In the figure, reference numeral 141L represents a landing point of the portion 141A, and 141S represents a tangential line at the landing point 141L.

In the comparative example shown in (b) of FIG. 6, once the follower 22*a* reaches the inflexion point 302 while sliding along the valve lift curve 301 of the valve-opening cam as indicated by arrows, it moves away from the inflexion point 302 but continues to move along the tangential line 301T at the inflexion point 302 so that it lands on the landing point 306L of the valve lift curve 306.

In the inventive example shown in (c) of FIG. 6, once the follower 22*a* reaches the inflexion point 146 while sliding along the valve lift curve 141 of the valve-closing cam 45 as indicated by arrows, it moves away from the inflexion point 146 at the jumping speed V4 (see FIG. 5) but continues to move, by an inertial force, along a tangential line 141T at the inflexion point 146 so that it lands on the second-order curved portion 131B. In the figure, reference numeral 131L represents a landing point of the second-order curved portion 131B, and 131S represents a tangential line at the landing point 131L.

In the comparative example shown in (d) of FIG. 6, once the follower 22*a* reaches the inflexion point 308 while sliding along the valve lift curve 306 of the valve-closing cam as indicated by arrows, it continues to move along the tangential line 306T at the inflexion point 308 so that it lands on the point 301L of the valve lift curve 301.

More specifically, the following operation takes place in the inventive example shown in (a) of FIG. 6 and in the comparative example shown in (b) of FIG. 6. In the comparative example shown in (b) of FIG. 6, the difference ΔVU between the jumping speed of the follower 22*a* at the inflexion point 302 and the landing speed of the follower 22*a* at the landing point 306L is great, so that the follower 22*a* collides against the valve lift curve 306 with a great impact force. Further, the follower 22*a* lands on the valve lift curve 306 at a great incidence angle θi11, and thus, a valve speed component of the follower 22*a*, perpendicular to the colliding surface, increases, which would also increase the colliding impact.

By contrast, in the inventive example shown in (a) of FIG. 6, where the follower 22*a* leaves the valve lift curve 131 at the inflexion point 133 where the cam rotation angle is smaller than that at the inflexion point 302 in the comparative example ((b) of FIG. 6), the jumping speed V3 (see FIG. 5) of the follower 22*a* is smaller than the jumping speed in the comparative example. The follower 22*a* lands on the second-order curved portion 141A with the same jumping speed V3 almost maintained throughout the movement of the follower 22*a*. Actually, however, the speed of the valve lift curve 141 (namely, valve speed of the valve-closing speed 45) changes during the time that the follower 22*a* jumps away from the valve lift curve 131 and lands on the valve lift curve 141, and thus, when the follower 22*a* lands on the second-order curved portion 141A at the point preceding the point of the cam rotation angle α2, the landing speed of the follower 22*a* merely becomes slightly lower than the jumping speed as seen in FIG. 5, so that the difference ΔV3 between the jumping speed and the landing speed, i.e. the colliding speed at which the follower 22*a* collides against the second-order curved portion 141A is reduced as compared to that in the comparative example shown in (b) of FIG. 6; as a consequence, the colliding impact and hence sound noise can be significantly reduced.

Further, the follower 22*a* lands on the second-order curved portion 141A of the valve lift curve 111 at an incidence angle θi3 smaller than the incidence angle θi11 in the comparative example shown in (b) of FIG. 6, and thus, the valve speed component of the follower 22*a*, perpendicular to the colliding surface, can be reduced as compared to that in the comparative example, which can also lower the colliding impact as compared to the comparative example.

Similar operation takes place in the inventive example shown in (c) of FIG. 6 and in the comparative example shown in (d) of FIG. 6. Namely, in the comparative example shown in (d) of FIG. 6, the difference ΔVL between the absolute values of the jumping speed and landing speed is great, and, due to the great difference ΔVL, the follower 22*a* would collide against the valve lift curve 301 with a great impact force. Further, the follower 22*a* lands on the valve lift curve 301 at a great incidence angle θi12, and thus, the valve speed component of the follower 22*a*, perpendicular to the colliding surface, increases, which would also increase the colliding impact.

By contrast, in the inventive example shown in (c) of FIG. 6, where the follower 22*a* leaves the valve lift curve 141 at the inflexion point 146 where the cam rotation angle is smaller than that at the inflexion point 308 in the comparative example ((b) of FIG. 6), the jumping speed V4 of the follower 22*a* is smaller than the jumping speed in the comparative example. The follower 22*a* lands on the second-order curved portion 131B with the same jumping speed V4 almost maintained throughout the movement of the follower 22*a*. Actually, however, the speed of the valve lift curve 131 (namely, valve speed of the valve-opening speed 44) changes during the time that the follower 22*a* jumps away from the valve lift curve 141 and lands on the valve lift curve 131, and thus, when the follower 22*a* lands on the second-order curved portion 131B at the point preceding the cam rotation angle α5, only the absolute value of the landing speed of the follower 22*a* becomes slightly lower than the jumping speed, so that the difference ΔV4 between the jumping speed and the landing speed, i.e. the speed (colliding speed) at which the follower 22*a* collides against the second-order curved portion 131B is reduced as compared to that in the comparative example shown in (d) of FIG. 6; as a consequence, the colliding impact and hence sound noise can be significantly reduced. Further, the follower 22*a* lands on the second-order curved portion 131B at an incidence angle θi4 smaller than the incidence angle θi12 in the comparative example shown in (d) of FIG. 6, and thus, the valve speed component of the follower 22*a*, perpendicular to the colliding surface, can be reduced as compared to that in the comparative example, which can also lower the colliding impact as compared to the comparative example.

Figure 7:
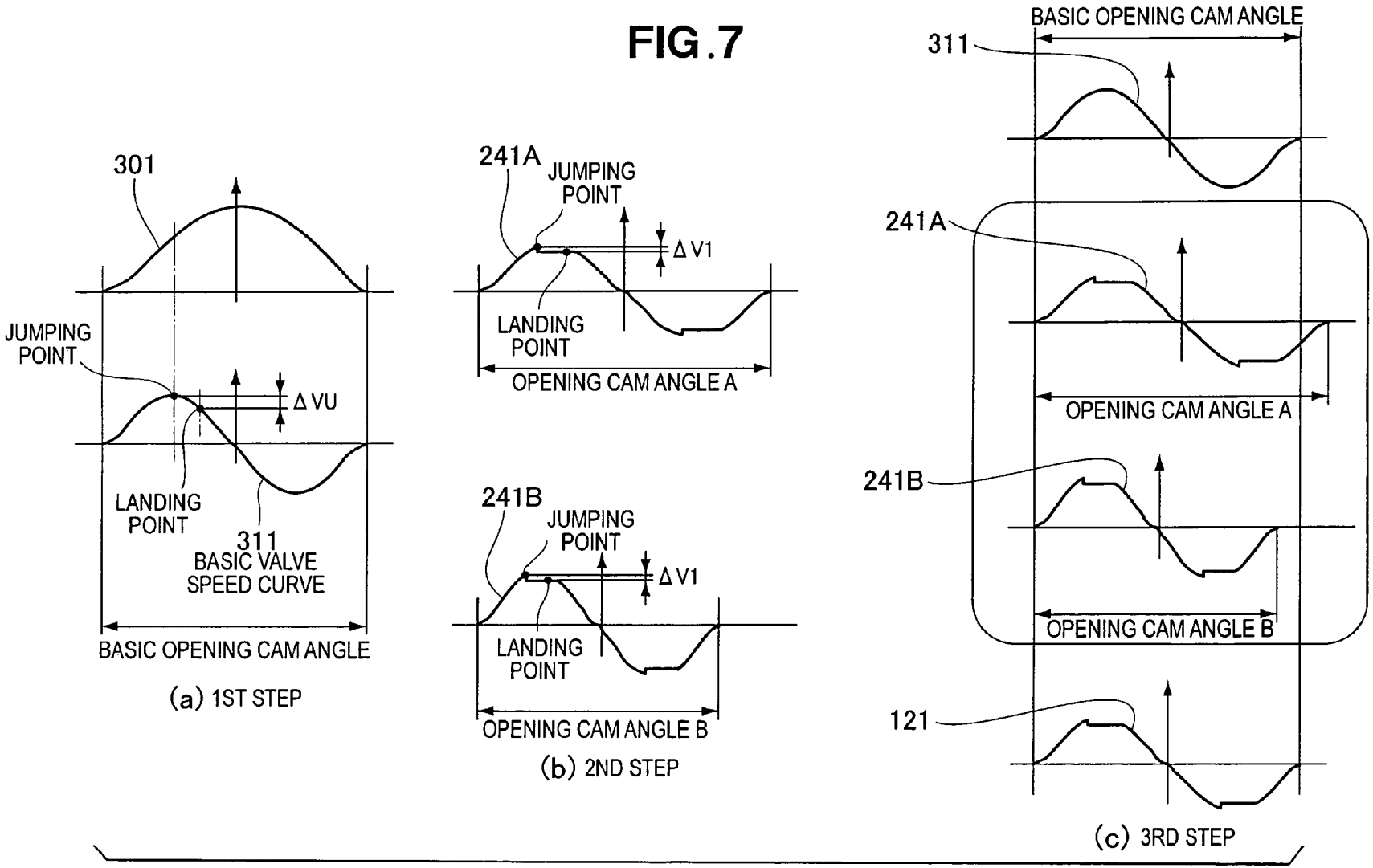
FIG. 7 is a diagram explanatory of a former half of an operational sequence for setting cam profiles of the valve-opening cam and valve-closing cam of the present invention.

FIG. 7 is a diagram explanatory of a former half of an operational sequence of a process for setting cam profiles of the valve-opening cam and valve-closing cam according to the present invention.

First step of the cam-profile setting process shown in (a) of FIG. 7 creates, on the basis of basic specifications of the internal combustion engine, the basic valve lift curve 301 and the basic valve speed curve 311 by differentiating the basic valve lift curve 301. Cam rotation angle range over which the valve is opened will be referred to as "basic opening cam angle".

Second step of the cam-profile setting process shown in (b) of FIG. 7 creates, for example, improved valve speed curves 241A and 241B each including a portion that has a speed difference (ultimate valve speed difference) ΔV1 smaller than a speed difference (basic valve speed difference) ΔVU in the basic valve speed curve 311 (see (a) of FIG. 7). Cam rotation angle range in the improved valve speed curves 241A over which the valve is opened will be referred to as "opening cam angle A", and a cam rotation angle range in the improved valve speed curves 241B over which the valve is opened will be referred to as "opening cam angle B".

Third step of the cam-profile setting process shown in (c) of FIG. 7 creates an ultimate valve speed curve 121 by adjusting an integrated valve speed value of the improved valve speed curves 241A and 241B to agree with or approach an integrated valve speed value of the basic valve speed curve 311. At this step, another operation is also performed for adjusting the opening cam angles A and B to the basic opening cam angle.

That the integrated valve speed value of the improved valve speed curves 241A and 241B agrees with or approach the integrated valve speed value of the basic valve speed curve 311 means that a difference between the integrated valve speed value of the basic valve speed curve 311 and the integrated valve speed value of the improved valve speed curves 241A and 241B falls within a range of 0-10% of the integrated valve speed value of the basic valve speed curve 311.

Figure 8:
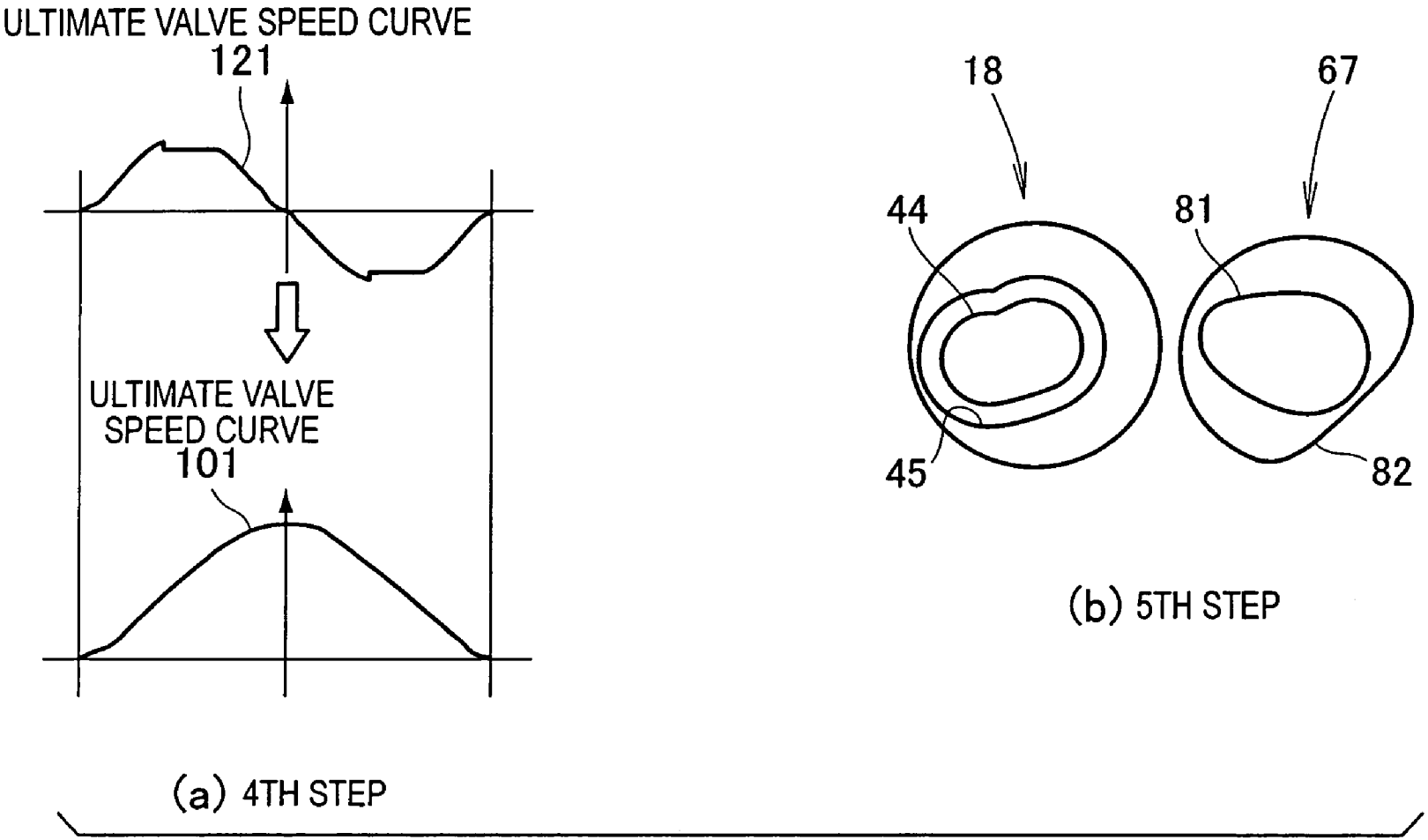
FIG. 8 is a diagram explanatory of a latter half of the operational sequence of the process for setting cam profiles of the valve-opening cam and valve-closing cam of the present invention.

FIG. 8 is a diagram explanatory of a latter half of the operational sequence of the process for setting cam profiles of the valve-opening cam and valve-closing cam of the present invention.

Fourth step of the cam-profile setting process shown in (a) of FIG. 8 creates, for example, an ultimate valve lift curve 101 of the valve-opening cam by integrating the above-mentioned ultimate valve speed curve 121. Note that an ultimate valve lift curve of the valve-closing cam is created on the basis of a combination of the ultimate valve lift curve 101 of the valve-opening cam and a valve lift amount difference therefrom.

Fifth step of the cam-profile setting process shown in (b) of FIG. 8 determines cam profiles of the valve-opening cams 44 and 81 and valve-closing cams 45 and 82 on the basis of a combination of the ultimate valve lift curve 101 ((a) of FIG. 8) and specifications of the rocker arms.

Figure 9:
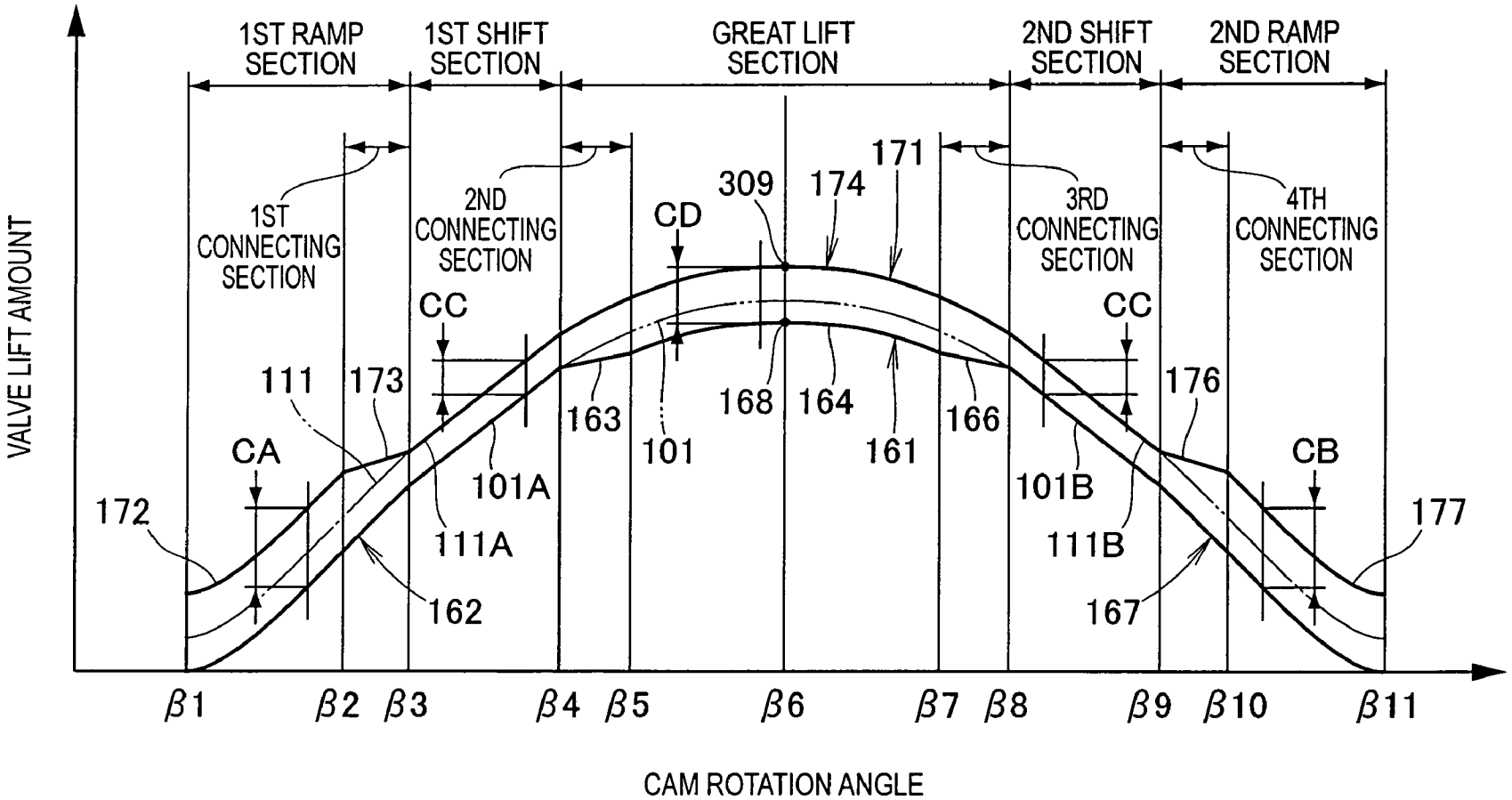
FIG. 9 is a diagram showing first modifications of the valve lift curves of the valve-opening and valve-closing cams.

FIG. 9 is a diagram showing first modifications of the valve lift curves of the valve-opening and valve-closing cams, in which the vertical axis represents the valve lift amounts while the horizontal axis represents the cam rotation angles.

In the figure, reference character 161 indicates a valve lift curve of the valve-opening cam having a middle curve section of a high mountain shape, which represents a modification of the valve lift curve 101 shown in FIG. 3. Reference character 171 indicates a valve lift curve of the valve-closing having a middle curve section of a high mountain shape, which represents a modification of the valve lift curve 111 shown in FIG. 3. Cam rotation angle range β3-β4 corresponds to the cam rotation angle range α1-α2 of FIG. 3, cam rotation angle β6 corresponds to the cam rotation angle α3 of FIG. 3, and cam rotation angle range β8-β9 corresponds to the cam rotation angle range α4-α5 of FIG. 3.

The valve lift curve 161 includes a first basic lift section 162 in the cam rotation angle range β1-β4, linear second connection section 163 in the cam rotation angle range β4-β5, great list section 164 in the cam rotation angle range β5-β7, linear third connection section 166 in the cam rotation angle range β7-β8, and second basic lift section 167 in the cam rotation angle range β8-β11. The first basic lift section 162 and second basic lift section 167 correspond to a part of the valve lift curve 101 shown in FIG. 3. The first basic lift section 162 includes a linear portion 101A, and the second basic lift section 167 includes a linear portion 101B.

The valve lift curve 171 includes a first correction ramp section 172 in the cam rotation angle range β1-β2, linear first connection section 173 in the cam rotation angle range β2-β3, basic lift section 174 in the cam rotation angle range β3-β9, linear fourth connection section 176 in the cam rotation angle range β9-β10, and second correction ramp section 177 in the cam rotation angle range β10-β11. The basic lift section 174 corresponds to a part of the valve lift curve 111 shown in FIG. 3. The basic lift section 174 is a part of the valve lift curve 111 and includes linear portions 11A and 111B.

The cam rotation angle includes: a first ramp section in the cam rotation angle range β1-β3 including mountain base portions of the valve lift curves 161 and 171; first shift section in the cam rotation angle range β3-β4 including mountain hillside portions of the valve lift curves 161 and 171; great lift section in the cam rotation angle range β4-β8 including maximum lift points 168 and 309 that are peaks of the valve lift curves 161 and 171 and neighborhoods of the maximum lift points 168 and 309; second shift section in the cam rotation angle range β8-β9 including mountain hillside portions of the valve lift curves 161 and 171; and second ramp section in the cam rotation angle range β9-β11 including the other mountain base portions of the valve lift curves 161 and 171.

The valve lift curve 161 includes a second connection section in the cam rotation angle range β4-β5, and a third connection section in the cam rotation angle range β7-β8. The valve lift curve 171 includes a first connection section in the cam rotation angle range β2-β5, and a fourth connection section in the cam rotation angle range β9-β10.

Clearance CA between the above-mentioned first basic lift section 162 of the valve lift curve 161 and the first correction ramp section 172 of the second valve lift curve 171, clearance CB between the above-mentioned second basic lift section 167 and the second correction ramp section 177 and clearance CD between the above-mentioned great lift section 164 and the basic lift section 174 are each set, for example, at 0.5 mm (i.e., CA=CB=CD=0.5 mm).

Namely, because the clearances CA, CB and CD between the valve lift curve 161 of the valve-opening cam and the valve lift curve 171 of the valve-closing cam are set to be greater than a clearance CC in the other sections than the first shift section and the second shift section of the cam rotation angle, it is not necessary to enhance the machining or manufacturing accuracy of the cam surfaces of the valve-opening and valve-closing cams except for cam surfaces corresponding to the first and second shift sections and the machining or manufacturing accuracy of component parts disposed between the cam surfaces and the air intake and exhaust valves, with the result that component parts, including the cam shaft, of the valve operation system can be reduced significantly.

Figure 10:
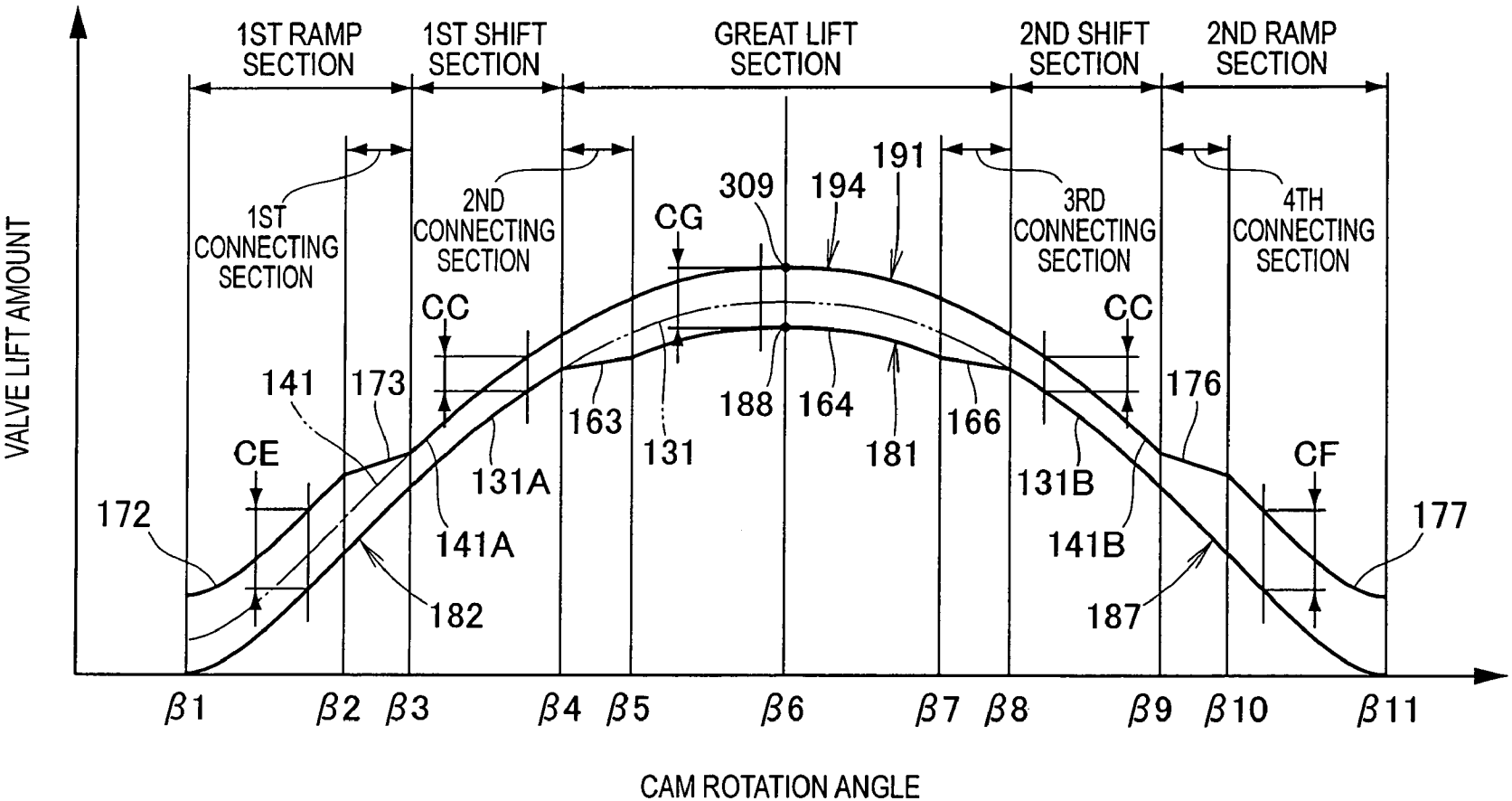
FIG. 10 is a diagram showing second modifications of the valve lift curves of the valve-opening and valve-closing cams.

FIG. 10 is a diagram showing second modifications of the valve lift curves of the valve-opening and valve-closing cams, in which the vertical axis represents the valve lift amounts while the horizontal axis represents the cam rotation angles, and in which the same elements as in FIG. 13 are indicated by the same reference characters as used in FIG. 13 and will not be described in detail to avoid unnecessary duplication.

In the figure, reference character 181 indicates a valve lift curve of the valve-opening cam having a middle curve section of a high mountain shape, which represents a modification of the valve lift curve 131 shown in FIG. 5. Reference character 191 indicates a valve lift curve of the valve-closing cam having a middle curve section of a high mountain shape, which represents a modification of the valve lift curve 141 shown in FIG. 5.

The valve lift curve 181 includes a first basic lift section 182 in the cam rotation angle range β1-β4, second connection section 163, great lift section 164, third connection section 166, and second basic lift section 187 in the cam rotation angle range β8-β11. The first basic lift section 182 and second basic lift section 187 correspond to a part of the valve lift curve 131 shown in FIG. 5. The first basic lift section 182 includes a second-order curve portion 131A, and the second basic lift section 187 includes a second-order curve portion 131B.

The valve lift curve 191 includes a first correction ramp section 172, first connection section 173, basic lift section 194 in the cam rotation angle range β3-β9, fourth connection section 176, and second correction ramp section 177. The basic lift section 194 corresponds to a part of the valve lift curve 141 shown in FIG. 5. The basic lift section 194 includes second-order curve portions 141A and 141B.

Clearance CE between the above-mentioned first basic lift section 182 of the valve lift curve 181 and the first correction ramp section 172 of the second valve lift curve 191, clearance CF between the above-mentioned second basic lift sections 187 and the second correction ramp section 177 and clearance CG between the above-mentioned great lift section 164 and the basic lift section 194 are each set at 0.5 mm (i.e., CE=CF=CG=0.5 mm).

Namely, because the clearances CE, CF and CG between the valve lift curve 181 of the valve-opening cam and the valve lift curve 191 of the valve-dosing cam are greater than a clearance CC in the other sections than the first shift section and the second shift section, it is not necessary to enhance the machining or manufacturing accuracy of the cam surfaces of the valve-opening and valve-closing cams except for the cam surfaces of the cams corresponding to the first second shift sections and the machining or manufacturing accuracy of component parts disposed between the cam surfaces and the air intake and exhaust valves, with the result that component parts, including the cam shaft, of the valve operation system can be reduced significantly.

The first and second ramp sections in the cam rotation angle include mountain base portions of the valve lift curves 181 and 191, the first and second shift sections include mountain hillside portions of the valve lift curves 181 and 191, and the great lift section in the cam rotation angle includes maximum lift points 188 and 309 that include peaks of the valve lift curves 181 and 191 and neighborhoods of the maximum lift points 188 and 309

The valve lift curve 181 also includes a second connection section in the cam rotation angle range β4-β5, and a third connection section in the cam rotation angle range β7-β8. The valve lift curve 191 also includes a first connection section in the cam rotation angle range β2-β3, and a third connection section in the cam rotation angle range β7-β8, and a fourth connection section in the cam rotation angle range β9-β10.

Figure 11:
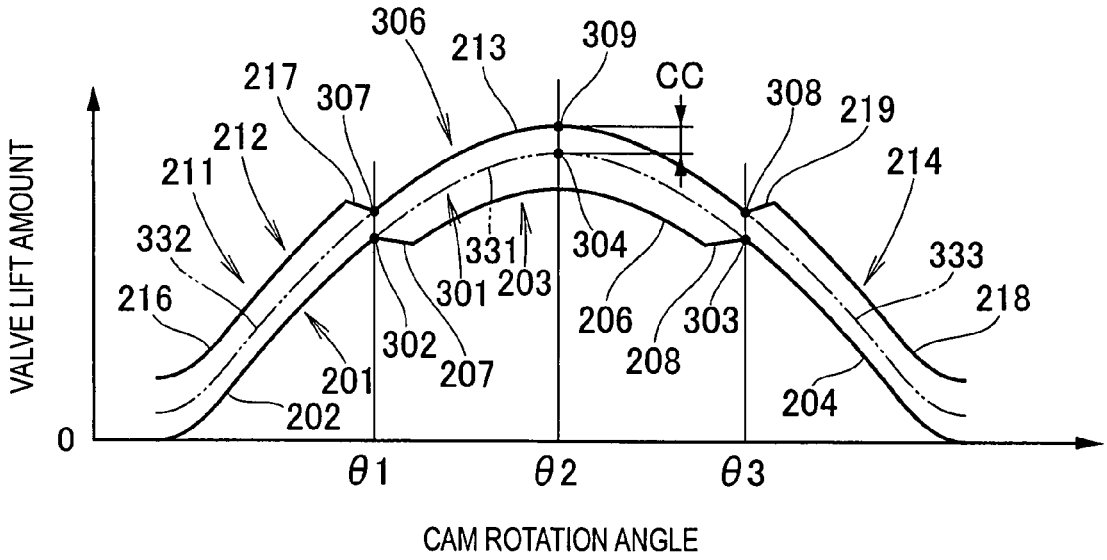
FIG. 11 is a diagram showing third modifications of the valve lift curves of the valve-opening and valve-closing cams.

FIG. 11 is a diagram showing third modifications of the valve lift curves of the valve-opening and valve-closing cams, in which the vertical axis represents the valve lift amounts while the horizontal axis represents the cam rotation angles, and in which the same elements as in FIG. 13 are indicated by the same reference characters as used in FIG. 13 and will not be described in detail to avoid unnecessary duplication.

Normal valve lift curve 201 of the valve-opening cam is different from the valve lift amount curve 301 of the valve-opening cam shown in FIG. 13 in that the valve lift amount in most of the cam rotation angle range θ1-θ3 is offset from the corresponding section of the curve 301 in a valve-lift-amount decreasing direction. The normal valve lift curve 201 generally comprises a first ramp curve 202 in a cam rotation angle range smaller than θ1, a great lift correction curve 203 in the cam rotation angle range θ1-θ3, and a second ramp curve 204 in a cam rotation angle range greater than θ3.

The first and second ramp curves 202 and 204 overlap the valve lift amount curve 301 shown in FIG. 13. The great lift correction curve 203 includes an intermediate curve section 206, and connecting curve sections 207 and 208 connected to the opposite ends of the intermediate curve section 206.

Normal valve lift curve 211 of the valve-closing cam is different from the valve lift amount curve 306 of the valve-closing cam shown in FIG. 13 in that the valve lift amounts in most of the cam rotation angle range smaller than θ1 and in most of the cam rotation angle range greater than θ3 are offset from the corresponding sections of the curve 306 in a valve-lift-amount increasing direction. The normal valve lift curve 211 generally comprises a first ramp correction curve 212 in the cam rotation angle range smaller than θ1, a great lift curve 213 in the cam rotation angle range θ1-θ3, and a second ramp correction curve 214 in the cam rotation angle range greater than θ3.

The first ramp correction curve 212 includes an end curve section 216 offset from a corresponding part of the valve lift amount curve 306 shown in FIG. 13, and a connecting curve section 217 connecting the end curve section 216 and the great lift curve 213. The great lift curve 213 overlap a corresponding part of the valve lift amount curve 306 shown in FIG. 13. The second ramp correction curve 204 includes an end curve section 218 offset from a corresponding part of the valve lift amount curve 306 shown in FIG. 13, and a connecting curve section 219 connecting the end curve section 218 and great lift curve 213.

As shown in (b) and (d) of FIG. 4, the follower 22*a* slides along the valve lift curve 301 until the cam rotation angle reaches θ1 is reached, jumps away from the valve lift curve 301 at the inflexion point 302, and lands on the valve lift curve 306 to slide therealong. Then, the follower 22*a* jumps away from the valve lift curve 306 at the inflexion point 308 at the cam rotation angle α3, and lands on the valve lift curve 301.

Namely, the cam rotation angle range θ1-θ3 of the valve lift curve 301, and the cam rotation angle range below the angle θ1 and cam rotation angle range above the angle θ3 of the valve lift curve 306 are ranges where the follower 22*a* does not slide.

Referring back to FIG. 11, the curve in the cam rotation angle range θ1-θ3 of the valve lift curve 301 will be referred to as "no-load curve section 331 of the valve-opening cam", the curve in the cam rotation angle range below the angle θ1 of the valve lift curve 306 as "no-load curve section 332 of the valve-closing cam", and the curve in the cam rotation angle range above the angle θ3 of the valve lift curve 306 as "no-load curve section 333 of the valve-closing cam.

Thus, it may be said that the intermediate curve section 206 is formed by offsetting most of the no-load curve section 331 in the valve-lift-amount decreasing direction, the end curve section 216 is formed by offsetting most of the no-load curve section 332 in the valve-lift-amount increasing direction and the end curve section 218 is formed by offsetting most of the no-load curve section 333 in the valve-lift-amount increasing direction.

At the jumping point 312 and landing point 316 of the valve speed curve (basic valve speed curve) 311 of the valve-opening cam shown in FIG. 13, the follower jumps out at the inflexion point 302 of the valve lift curve 301 and lands at the landing point 306L (see (b) of FIG. 4), and thus, the follower slides over the valve-opening cam surface in the cam rotation angle range below the cam rotation angle θ1 at the inflexion point 302, and slides over the valve-dosing cam surface in the cam rotation angle range above the cam rotation angle at the inflexion point 306L.

Namely, according to the present invention, in the cam rotation angle range where the follower slides, one of the valve lift curves 301 and 306, along which the follower slides, is used as-is. But, in the cam rotation angle range where the follower does not slide, the great valve lift correction curve 203, first ramp correction curve 212 and second ramp correction curve 214 are set as no-load valve lift slide curves by one of the valve lift curves 301 and 306 along which the follower does not slide being offset away from the other of the valve lift curves 306 and 301, the normal valve lift curve 201 of the valve-opening cam is set with the first ramp curve 202, great lift correction curve 203 and second ramp curve 204, and the cam profile of the valve-opening cam is determined on the basis of the normal valve lift curve 201; in addition, the normal valve lift curve 211 of the valve-closing cam is set with the first ramp correction curve 212, great lift curve 213 and second ramp correction curve 214, and the cam profile of the valve-closing cam is determined on the basis of the normal valve lift curve 211.

Namely, because the no-load-side basic valve lift curve section, along which the follower does not slide, is offset away from the other basic valve lift curve, the present invention can increase the clearance between the normal valve lift curves of the valve-opening and valve-closing cams, to thereby reduce viscosity resistance and agitation resistance of lubricating oil between the cam of the non-sliding side and the corresponding follower and greatly reduce friction between the cam and the sliding portion of the follower.

Further, no high dimensional accuracy is required of the follower and cam of the non-sliding side; namely, no high-accuracy management is required of the clearance between the valve-opening cam and the valve-closing cam, so that it is possible to eliminate the need for enhancing the cam manufacturing accuracy and assembling accuracy and thus achieve significant cost reduction.

Figure 12:
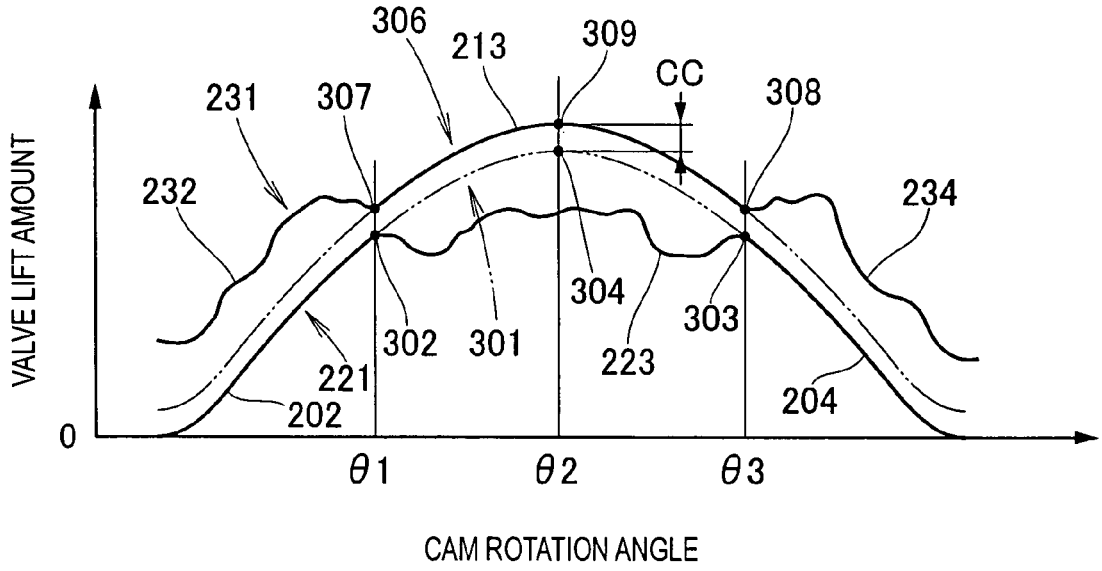
FIG. 12 is a diagram showing fourth modifications of the valve lift curves of the valve-opening and valve-closing cams.

FIG. 12 is a diagram showing fourth modifications of the valve lift curves of the valve-opening and valve-closing cams, in which the vertical axis represents the valve lift amounts while the horizontal axis represents the cam rotation angles, and in which the same elements as in FIG. 13 are indicated by the same reference characters as used in FIG. 13 and will not be described in detail to avoid unnecessary duplication.

Normal valve lift curve 221 of the valve-opening cam has, in the cam rotation angle range θ1-θ3, a section modified, relative to the valve lift curve 301 of the valve-opening cam shown in FIG. 13, into a shape such that the modified section is smaller in valve lift amount than the corresponding section of the curve 301. Specifically, the normal valve lift curve 221 comprises a first ramp curve 202 in the cam rotation angle range below θ1, a middle correction curve 223 in the cam rotation angle range θ1-θ3, and a second ramp curve 204 in the cam rotation angle range above θ3.

The middle correction curve 223 may be any desired curve, such as an algebraic curve that can be expressed easily with a mathematical expression, or a free curve that has continuity and is difficult to express with a mathematical expression.

Normal valve lift curve 231 of the valve-dosing cam has, in the cam rotation angle range below θ1 and cam rotation angle range above θ3, sections modified, relative to the valve lift curve 306 of the valve-closing cam, into a shape such that the modified sections are greater in valve lift amount than the corresponding sections of the curve 306 shown in FIG. 13. Specifically, the normal valve lift curve 231 comprises an end correction curve 232 in the cam rotation angle range below θ1, a great lift curve 213 in the cam rotation angle range θ1-θ3, and an end correction curve 234 in the cam rotation angle range above θ3.

The end correction curves 232 and 234 may each be any desired curve, such as an algebraic curve that can be expressed easily with a mathematical expression, or a free curve that has continuity and is difficult to express with a mathematical expression.

As described above in relation to FIGS. 1, 11 and 12, the valve-opening and valve-closing cams 44 and 45, which forcibly drive the air intake valve 12 and exhaust valve 13, are characterized by having their respective cam profiles set by: plotting, in a graph where the vertical axis represents the valve lift amounts of the air intake valve 12 and exhaust valve 13 and the horizontal axis represents the cam rotation angles, the basic valve lift curve 301 of the valve-opening cam 44 indicative of relationship between the cam rotation angles and valve lift amounts of the valve-opening cam 44 and the basic valve lift curve 306 of the valve-closing cam 45 indicative of relationship between the cam rotation angles and valve lift amounts of the valve-closing cams 45 by offsetting the basic valve lift curve 301 of the valve-opening cam 44 in the valve-lift-amount increasing direction; setting the intermediate curve section 206, as a no-load valve lift correction curve, by offsetting the no-load curve section 331 of the basic valve lift curve 301 of the valve-opening cam 44, along which a corresponding one of the followers 22*a* for actuating the air intake valve 12 and exhaust valve 13 does not slide relative to the cam 44, away from the other basic valve lift curve 306 and setting the end curve sections 216 and 218, as no-load valve lift correction curves, by offsetting the no-load curve sections 332 and 333 of the basic valve lift curve 306 of the valve-closing cam 45, along which the follower 22*a* does not slide relative to the cam 45, away from the other basic valve lift curve 301, or by modifying such offset no-load curve sections 331, 332 and 333 into desired shapes; and forming the normal valve lift curves 201 and 211 by connecting, as needed, the no-load valve lift correction curves with the remaining sections of the corresponding basic valve lift curves 301 and 306 via the connecting curve sections 207, 208, 217 and 219, the cam profiles of the valve-opening and valve-closing cams 44 and 45 being set on the basis of the normal valve lift curves 201 and 211.

Further, as described above in relation to FIGS. 1 and 9, the basic valve lift curve 101 of the valve-opening cam 44 and basic valve lift curve 111 of the valve-closing cam 45 each have a middle curve section of a high mountain shape, two cam rotation angle ranges including the mountain base portions of each of the basic valve lift curves 101 and 111 are set as the first and second ramp sections, one of the two cam rotation angle ranges including the mountain hillside portions of each of the basic valve lift curves 101 and 111, where the follower 22*a* of the air intake valve or exhaust valve shifts from the valve-opening cam 44 to the valve-closing cam 45, is set as the first shift section while the other of the two cam rotation angle ranges including the mountain hillside portions, where the follower 22*a* shifts from the valve-closing cam 45 to the valve-opening cam 44, is set as the second shift section, and another cam rotation angle range including the mountain top portion of each of the basic valve lift curves 101 and 111 is set as the great lift section. Further, as shown in FIG. 9, the normal valve lift curve 161 of the valve-opening cam 44 is formed by connecting together, via the second and third connecting curve section sections 163 and 166, the no-load valve lift correction curve 164 of the valve-opening cam 44, formed by offsetting the great lift section of the basic valve lift curve 101 of the valve-opening cam 44 in the valve-lift-amount decreasing direction, the first and second shift sections of the valve lift curve 101 and the first and second ramp sections of the valve lift curve 101, and the cam profile of the valve-opening cam 44 is set on the basis of the normal valve lift curve 161. Similarly, the normal valve lift curve 171 of the valve-closing cam 45 is formed by connecting together, via the first and fourth connection (curve) sections 173 and 176, the first correction ramp section 172 and second correction ramp section 177 as the no-load valve lift correction curve of the valve-closing cam 45, formed by offsetting the first and second ramp sections of the basic valve lift curve 111 of the valve-closing cam 45 in the valve-lift-amount increasing direction, the first and second shift sections of the valve lift curve 111 and the great lift section of the curve 111, and the cam profile of the valve-closing cam 45 is set on the basis of the normal valve lift curve 171 of the valve-closing cam 45.

With the aforementioned arrangements, portions of the clearance between the normal valve lift curve 161 of the valve-opening cam 44 and the normal valve lift curve 171 of the valve-closing cam 45 can be set to increased sizes. Thus, the clearance has to be managed with high accuracy only in the first and second shift sections; namely, the clearance need not be managed with high accuracy in the other sections than the first and second shift sections. Consequently, high machining or manufacturing accuracy and assembling accuracy is required of the various component parts of the valve operating device 15, which can thereby achieve significant cost reduction of the internal combustion engine 10.

Further, with the size increase of the clearance, the viscosity resistance and agitation resistance of the lubricating oil between the valve-opening and valve-closing cams 44 and 45 and the followers 22*a* can be effectively reduced, so that the performance, such as the output and fuel efficiency, of the internal combustion engine 10 can be significantly enhanced.

Note that, whereas the preferred embodiment has been described above in relation to the case where the first, second, third and fourth connection sections 173, 162, 166 and 176 are formed as straight lines, the present invention is not so limited and these connection sections 173, 162, 166 and 176 may be formed as curved lines that smoothly connect to adjoining lines.

Further, whereas the first correction ramp section 172 in the preferred embodiment has been described above as formed by offsetting upwardly the ramp section in the cam rotation angle range β1-β2 of the first basic lift section 162 and the second correction ramp section 177 has been described above as formed by offsetting upwardly the ramp section from the cam rotation angle range β10-β11 of the second basic lift section 167, the present invention is not so limited; for example, the first correction ramp section 172 may be formed continuously with the first connection section 173 with the clearance between the first connection section 173 and the first basic lift section 162 gradually increasing in size in a direction from the cam rotation angle β3 toward the cam rotation angle β1, and the second correction ramp section 177 may be formed continuously with the fourth connection section 176 with the clearance between the fourth connection section 176 and the second basic lift section 167 gradually increasing in size in a direction from the cam rotation angle β9 toward the cam rotation angle β11.

Further, as described above in relation to FIGS. 1, 3 and 13, the valve-opening and valve-closing cams 44 and 45, which forcibly drive the air intake valve 12 and exhaust valve 13, are characterized by having their respective cam profiles set by: plotting, in a graph where the vertical axis represents the valve lift amounts of the air intake valve 12 and exhaust valve 13 and the horizontal axis represents the cam rotation angles, the basic valve lift curve 301 of the valve-opening cam 44, indicative of relationship between the cam rotation angles and valve lift amounts of the valve-opening cam 44, and the basic valve lift curve 306 of the valve-closing cam 45, indicative of relationship between the cam rotation angles and valve lift amounts of the valve-closing cams 45; setting the clearance CC between the basic valve lift curves 301 and 306 as a valve lift amount difference between the curves 301 and 306; setting, with respect to the basic valve lift curves 301 and 306, the ultimate valve lift curves 101 and 111 of the valve-opening and valve-closing cams 44 and 45 each provided with the first shift section including a cam rotation angle range where a corresponding one of the followers 22*a* for actuating the air intake valve 12 and exhaust valve 13 jumps away from the valve-opening cam 44 and lands on the valve-closing cam 45 and the second shift section including a cam rotation angle range where the follower 22*a* jumps away from the valve-closing cam 45 and lands on the valve-opening cam 44; determining the basic speed difference ΔVU indicative of a difference between jumping and landing speeds of the follower 22*a* on the basic valve speed curve 311 determined from the basic valve lift curves 301 and 306 of the valve-opening and valve-closing cams 44 and 45; and determining the ultimate speed difference ΔV1 indicative of a difference between jumping and landing speeds of the follower 22*a* on the ultimate valve speed curve 121 determined from the ultimate valve lift curves 101 and 111 of the valve-opening and valve-closing cams 44 and 45, the respective cam profiles of the valve-opening and valve-closing cams 44 and 45 being set in such a manner that the ultimate speed difference ΔV1 is smaller than the basic speed difference ΔVU.

With the aforementioned arrangements, it is possible to reduce the colliding speed at which the follower 22*a* collides against the valve-opening or valve-closing cam 44 or 45 in the first and second shift sections even in the case where the clearance between the lift curves 101 and 111 of the valve-opening and valve-closing cams 44 and 45. Because the impact at the time of the collision can be lessened in this manner, the present invention can effectively minimize production of noise sound while minimizing the necessary cost.

Further, the cam profiles are set in such a manner that, in the first and second shift sections, the absolute value of the valve speed at the jumping point 123 as the peak of the ultimate valve speed curve 121 is set to be smaller than the absolute value of the valve speed at the maximum speed point 312 as the peak of the basic valve speed curve 311, and that the absolute values of the landing speeds on the valve speed curve 121 in the first and second shift sections are kept at constant values corresponding to higher speed-curve positions than the corresponding absolute values of the landing speeds on the basic valve speed curve 311; more specifically, the absolute value of the landing speed on the valve speed curve 121 in the first shift section (i.e., positive speed region) is kept at a constant value greater than the corresponding absolute value of the landing speed of the basic valve speed curve 311, while the absolute value of the landing speed on the valve speed curve 121 in the second shift section (i.e., negative speed region) is kept at a constant value smaller than the corresponding absolute value of the landing speed of the basic valve speed curve 311. In this way, not only the jumping speed V1 of the follower 22*a* on the valve speed curve 121 is limited, but also the landing speed of the follower 22*a* on the valve speed curve 121 is increased. Thus, it is possible to decrease the speed difference ΔV1 between the jumping speed V1 and landing speed of the follower 22*a*, so that the colliding speed of the follower 22*a* against the vale-opening or valve-closing cam 44 or 45 can be reduced and thus the impact at the time of the collision can be effectively lessened.

Furthermore, as described above in relation to FIGS. 1, 3, 7, 8 and 13, the method for setting the cam profiles of the valve-opening and valve-closing cams 44 and 45, which forcibly drive the air intake valve 12 and exhaust valve 13, is characterized by comprising: the first step of plotting valve lift curves 201 and 306 on the basis of a predetermined lift amount required of the air intake valve 12 or exhaust valve 13 and a valve speed curve from the valve lift curves; the second step of determining a basic speed difference between the jumping speed VU and landing speed, on the basic speed curve 311, of a corresponding one of the followers 22*a*, provided for actuating the air intake valve 12 and exhaust valve 13, when the follower 22*a* jumps away from the valve-opening cam 44 and lands on the valve-closing cam 45 or when the follower 22*a* jumps away from the valve-closing cam 45 and lands on the valve-opening cam 44, and plotting improved valve speed curves 241A and 241B such that the speed difference ΔV1 between the jumping speed VU and landing speed of the follower 22*a* is smaller than the speed difference ΔVU; the third step of adjusting integrated values of the valve speeds indicated by the improved valve speed curves 241A and 241B to integrated values of the valve speeds indicated by the valve speed curve 311 while maintaining the improved speed difference ΔV1 and thereby obtaining the ultimate valve speed curve 121; and the fourth step of plotting the valve lift curves 101 and 111 on the basis of the ultimate valve speed curve 121.

With the aforementioned second step, it is possible to reduce the colliding speed at which the follower 22*a* collides against the valve-opening cam 44 or valve-closing cam 45, to thereby lessen the colliding impact. Further, with the third step, which adjusts the integrated values of the valve speeds indicated by the improved valve speed curves 241A and 241B to the integrated values of the valve speeds indicated by the valve speed curve 311 while maintaining the improved speed difference ΔV1, it is possible to cause the shape of the ultimate valve lift curve 101 to agree with or approach the shape of the valve lift curve 301, except in a section that includes the range where the follower 22*a* jumps away from the valve-opening cam 44 and lands on the valve-closing cam 45 or where the follower 22*a* jumps away from the valve-closing cam 45 and lands on the valve-opening cam 44.

The embodiment shown in FIG. 1 has been described above as constructed so that the rocker arm 22 is driven by the cam groove 42 of the cam shaft 18, via the follower 22*a*, to open/close the air intake valve 12, and the embodiment shown in FIG. 2 has been described above as constructed so that the air intake valve 62 is opened/closed by the valve-opening cam 81 and valve-closing cam 82 of the cam shaft 67 via the rocker arms 73 and 74. However, the present invention is not so limited, and the end section 62A of the air intake valve 62 shown in FIG. 2 may be constructed to function as a follower that slides along the cam groove 42 so that the air intake valve 62 of FIG. 2 is opened/closed directly by the cam groove 42.

The valve operating device and cam-profile setting method of the present invention are suitably applicable to forced-valve-opening/closing cams for an internal combustion engine.

What is claimed is:

1. A cam mechanism having forced-valve-opening and valve-closing cams for forcibly driving an air intake valve and exhaust valve, said valve-opening and valve-closing cams having respective cam profiles set on the basis of normal valve lift amount curves that are provided by:

plotting, in a graph where a vertical axis represents valve lift amounts of the air intake valve and exhaust valve and a horizontal axis represents cam rotation angles, a basic valve lift curve of the valve-opening cam indicative of relationship between the cam rotation angles and valve lift amounts of the valve-opening cam and a basic valve lift curve of the valve-closing cam indicative of relationship between the cam rotation angles and valve lift amounts of the valve-closing cam by offsetting the basic valve lift curve of the valve-opening cam in a valve-lift-amount increasing direction;

setting no-load valve lift correction curves of the valve-opening and valve-closing cams by offsetting a no-load curve section of the basic valve lift curve of the valve-opening cam, along which a corresponding one of the followers for actuating the air intake valve and exhaust valve does not slide, away from the basic valve lift curve of the valve-closing cam and by offsetting a no-load curve section of the basic valve lift curve of the valve-closing cam, along which the follower does not slide, away from the basic valve lift curve of the valve-opening cam, or by modifying the offset no-load curve sections into desired shapes; and forming respective normal valve lift curves of the valve-opening and valve-closing cams by connecting the no-load valve lift correction curves with remaining sections of corresponding ones of the basic valve lift curves, the cam profiles of the valve-opening and valve-closing cams being set on the basis of the respective normal valve lift curves.

2. The cam mechanism of claim 1, wherein the basic valve lift curve of the valve-opening cam and the basic valve lift curve of the valve-closing cam each have a middle curve section of a high mountain shape, two cam rotation angle ranges including mountain base portions of each of the basic valve lift curves of the valve-opening and valve-closing cams being set as first and second ramp sections, one of two cam rotation angle ranges including mountain hillside portions of each of the basic valve lift curves, where the follower of the air intake valve or exhaust valve shifts from the valve-opening cam to the valve-closing cam, being set as a first shift section while other of the two cam rotation angle ranges, where the follower shifts from the valve-closing cam to the valve-opening cam, being set as a second shift section, another cam rotation angle range including a mountain top portion of each of the basic valve lift curves being set as a great lift section, wherein the normal valve lift curve of the valve-opening cam is formed by connecting together, via connecting curve sections, the no-load valve lift correction curve of the valve-opening cam, formed by offsetting the great lift section of the basic valve lift curve of the valve-opening cam in a valve-lift-amount decreasing direction, the first and second shift sections and the first and second ramp sections of the basic valve lift curve of the valve-opening cam, the cam profile of the valve-opening cam being set on the basis of the normal valve lift curve of the valve-opening cam, and wherein the normal valve lift curve of the valve-closing cam is formed by connecting together, via connecting curve sections, the no-load valve lift correction curve of the valve-closing cam, formed by offsetting the first and second ramp sections of the basic valve lift curve of the valve-closing cam in the valve-lift-amount increasing direction, the first and second shift sections and the great lift section of the basic valve lift curve of the valve-closing cam, the cam profile of the valve-closing cam being set on the basis of the normal valve lift curve of the valve-closing cam.

3. A cam mechanism having forced-valve-opening and valve-closing cams for forcibly driving an air intake valve and exhaust valve, the valve-opening and valve-closing cams having respective cam profiles set by:

plotting, in a graph where a vertical axis represents valve lift amounts of the air intake valve and exhaust valve and a horizontal axis represents cam rotation angles, a basic valve lift curve of the valve-opening cam indicative of relationship between the cam rotation angles and valve lift amounts of the valve-opening cam and a basic valve lift curve of the valve-closing cam indicative of relationship between the cam rotation angles and valve lift amounts of the valve-closing cam, a valve lift amount difference being provided between the basic valve lift curves of the valve-opening and valve-closing cams;

setting, with respect to the basic valve lift curves of the valve-opening and valve-closing cams, ultimate valve lift curves of the valve-opening and valve-closing cams each including, as cam rotation angle ranges, a first shift section including a range where a corresponding one of the followers for actuating the air intake valve and exhaust valve jumps away from the valve-opening cam and lands on the valve-closing cam and a second shift section including a range where the follower jumps away from the valve-closing cam and lands on the valve-opening cam;

determining a basic speed difference indicative of a difference between jumping and landing speeds of the follower on a basic valve speed curve determined from the basic valve lift curves of the valve-opening and valve-closing cams; and determining an ultimate speed difference indicative of a difference between jumping and landing speeds of the follower on an ultimate valve speed curve determined from the ultimate valve lift curves of the valve-opening and valve-closing cams, the respective cam profiles of the valve-opening and valve-closing cams being set in such a manner that the ultimate speed difference is smaller than the basic speed difference.

4. The cam mechanism of claim 3, wherein the cam profiles of the valve-opening and valve-closing cams are set in such a manner that, in said first and second shift sections, an absolute value of the valve speed at a peak of the ultimate valve speed curve is set to be smaller than an absolute value of the valve speed at a peak of the basic valve speed curve, and that the absolute values of the landing speeds on the ultimate valve speed curve in the first and second shift sections are kept at respective constant values corresponding to higher speed-curve positions than the absolute values of the landing speeds on the basic valve speed curve.

5. A method for setting cam profiles of forced-valve-opening and valve-closing cams for forcibly driving an air intake valve and exhaust valve, said method comprising:

a first step of plotting a basic valve lift curve on the basis of a predetermined lift amount required of the air intake valve or exhaust valve and a valve speed curve from the basic valve lift curves;

a second step of determining a basic speed difference indicative of a difference between a jumping speed and a landing speed, on the basic speed curve, when a corresponding one of followers for actuating the air intake valve and exhaust valve jumps away from the valve-opening cam and lands on the valve-closing cam or when the follower jumps away from the valve-closing cam and lands on the valve-opening cam, and plotting an improved valve speed curve such that an improved speed difference indicative of a difference between jumping and landing speeds, on the improved valve speed curve, of the follower is smaller than the basic speed difference;

a third step of adjusting integrated values of the valve speeds indicated by the improved valve speed curve to integrated values of the valve speeds indicated by the basic valve speed curve while maintaining the improved speed difference and thereby obtaining an ultimate valve speed curve; and a fourth step of plotting an ultimate valve lift curve on the basis of the ultimate valve speed curve.

6. A method for setting cam profiles of valve-opening and valve-closing cams for forcibly driving an air intake valve and exhaust valve, said method comprising:

a step of plotting, in a graph where a vertical axis represents valve lift amounts of the air intake valve and exhaust valve and a horizontal axis represents cam rotation angles, a basic valve lift curve of the valve-opening cam indicative of relationship between the cam rotation angles and valve lift amounts of the valve-opening cam and a basic valve lift curve of the valve-closing cam indicative of relationship between the cam rotation angles and valve lift amounts of the valve-closing cam by offsetting the basic valve lift curve of the valve-opening cam in a valve-lift-amount increasing direction;

a step of setting no-load valve lift correction curves of the valve-opening and valve-closing cams by offsetting a no-load curve section of the basic valve lift curve of the valve-opening cam, along which a corresponding one of the followers for actuating the air intake valve and exhaust valve does not slide, away from the basic valve lift curve of the valve-closing cam and by offsetting a no-load curve section of the basic valve lift curve of the valve-closing cam, along which the follower does not slide, away from the basic valve lift curve of the valve-opening cam, or by modifying the offset no-load curve sections into desired shapes;

a step of forming respective normal valve lift curves of the valve-opening and valve-closing cams by connecting the no-load valve lift correction curves with remaining sections of corresponding ones of the basic valve lift curves; and a step of forming the cam profiles of the valve-opening and valve-closing cams on the basis of the respective normal valve lift curves.

7. The method of claim 6, wherein the basic valve lift curve of the valve-opening cam and the basic valve lift curve of the valve-closing cam each have a middle curve section of a high mountain shape, two cam rotation angle ranges including mountain base portions of each of the basic valve lift curves of the valve-opening and valve-closing cams being set as first and second ramp sections, one of two cam rotation angle ranges including mountain hillside portions of each of the basic valve lift curves, where the follower of the air intake valve or exhaust valve shifts from the valve-opening cam to the valve-closing cam, being set as a first shift section while other of the two cam rotation angle ranges, where the follower shifts from the valve-closing cam to the valve-opening cam, being set as a second shift section, another cam rotation angle range including a mountain top portion of each of the basic valve lift curves being set as a great lift section, wherein the normal valve lift curve of the valve-opening cam is formed by connecting together, via connecting curve sections, the no-load valve lift correction curve of the valve-opening cam, formed by offsetting the great lift section of the basic valve lift curve of the valve-opening cam in a valve-lift-amount decreasing direction, the first and second shift sections and the first and second ramp sections of the basic valve lift curve of the valve-opening cam, the cam profile of the valve-opening cam being set on the basis of the normal valve lift curve of the valve-opening cam, and wherein the normal valve lift curve of the valve-closing cam is formed by connecting together, via connecting curve sections, the no-load valve lift correction curve of the valve-closing cam, formed by offsetting the first and second ramp sections of the basic valve lift curve of the valve-closing cam in the valve-lift-amount increasing direction, the first and second shift sections and the great lift section of the basic valve lift curve of the valve-closing cam, the cam profile of the valve-closing cam being set on the basis of the normal valve lift curve of the valve-closing cam.

8. A method for setting cam profiles of valve-opening and valve-closing cams for forcibly driving an air intake valve and exhaust valve, said method comprising:

a step of plotting, in a graph where a vertical axis represents valve lift amounts of the air intake valve and exhaust valve and a horizontal axis represents cam rotation angles, a basic valve lift curve of the valve-opening cam indicative of relationship between the cam rotation angles and valve lift amounts of the valve-opening cam and a basic valve lift curve of the valve-closing cam indicative of relationship between the cam rotation angles and valve lift amounts of the valve-closing cam, a valve lift amount difference being provided between the basic valve lift curves of the valve-opening and valve-closing cams;

a step of setting, with respect to the basic valve lift curves of the valve-opening and valve-closing cams, ultimate valve lift curves of the valve-opening and valve-closing cams each including, as cam rotation angle ranges, a first shift section including a range where a corresponding one of the followers for actuating the air intake valve and exhaust valve jumps away from the valve-opening cam and lands on the valve-closing cam and a second shift section including a range where the follower jumps away from the valve-closing cam and lands on the valve-opening cam;

a step of determining a basic speed difference indicative of a difference between jumping and landing speeds of the follower on a basic valve speed curve determined from the basic valve lift curves of the valve-opening and valve-closing cams;

a step of determining an ultimate speed difference indicative of a difference between jumping and landing speeds of the follower on an ultimate valve speed curve determined from the ultimate valve lift curves of the valve-opening and valve-closing cams; and a step of setting the cam profiles of the valve-opening and valve-closing cams in such a manner that the ultimate speed difference is smaller than the basic speed difference.

9. The method of claim 8, wherein the cam profiles of the valve-opening and valve-closing cams are set in such a manner that, in said first and second shift sections, an absolute value of the valve speed at a peak of the ultimate valve speed curve is set to be smaller than an absolute value of the valve speed at a peak of the basic valve speed curve, and that the absolute values of the landing speeds on the ultimate valve speed curve in the first and second shift sections are kept at respective constant values corresponding to higher speed-curve positions than the absolute values of the landing speeds on the basic valve speed curve.

* * * * *